US007551866B2

(12) United States Patent
Watanabe et al.

(10) Patent No.: US 7,551,866 B2
(45) Date of Patent: Jun. 23, 2009

(54) IMAGE FORMING METHOD AND APPARATUS WITH IMPROVED CONVERSION CAPABILITY OF AMOUNT OF TONER ADHESION

(75) Inventors: Naoto Watanabe, Atsugi (JP); Shin Hasegawa, Zama (JP); Hideki Kamaji, Atsugi (JP); Shinji Kato, Kawasaki (JP); Hitoshi Ishibashi, Kamakura (JP); Kohta Fujimori, Yokohama (JP); Kayoko Tanaka, Edogawa-ku (JP); Yuushi Hirayama, Sagamihara (JP); Takashi Enami, Chigasaki (JP); Shinji Kobayashi, Atsugi (JP); Kazumi Kobayashi, Setagaya-ku (JP); Fukutoshi Uchida, Kawasaki (JP); Noboru Sawayama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 198 days.

(21) Appl. No.: 11/477,673

(22) Filed: Jun. 30, 2006

(65) Prior Publication Data

US 2007/0019976 A1 Jan. 25, 2007

(30) Foreign Application Priority Data

Jun. 30, 2005 (JP) ..... 2005-193026

(51) Int. Cl.
*G03G 15/00* (2006.01)

(52) U.S. Cl. ..... 399/49; 399/64; 399/72; 347/19

(58) Field of Classification Search ..... 399/49, 399/64, 72; 347/19
See application file for complete search history.

(56) References Cited

U.S. PATENT DOCUMENTS 4,312,589 A * 1/1982 Brannan et al. ..... 399/43

(Continued)

FOREIGN PATENT DOCUMENTS

JP 04-267274 9/1992

(Continued)

OTHER PUBLICATIONS

U.S. Appl. No. 07/545,508, filed Jun. 29, 1990.

(Continued)

*Primary Examiner*—David M Gray
*Assistant Examiner*—G. M. Hyder
(74) *Attorney, Agent, or Firm*—Oblon, Spivak, McClelland, Maier & Neustadt, P.C.

(57) ABSTRACT

An image forming method and apparatus capable of implementing accurately and constantly an improved conversion of the amount of toner adhesion over the entire range of the amount of adhesion. The method includes the steps of computing a normalization value as a relative output ratio of the regular reflection output to a background regular reflection component from the surface extracted from the regular reflection light, in which the regular reflection output is obtained by detecting a plurality of gradation toner patterns with a sensor configured to simultaneously detect regular reflection light and diffuse reflection light; obtaining a diffuse reflection output conversion factor by either (1) subtracting the normalization value multiplied by the diffuse reflection output voltage generated by the surface from the diffuse reflection output voltage, or (2) subtracting the normalization value multiplied by a diffuse reflection output voltage increment, which is computed as the difference between the diffuse reflection output voltage and another diffuse reflection output voltage obtained when a light emitting device is turned off, from the diffuse reflection output voltage increment; and subjecting the relation between the diffuse reflection output conversion factor and the amount of adhesion to a polynomial approximation.

9 Claims, 20 Drawing Sheets

U.S. PATENT DOCUMENTS

| | | | | |
|---|---|---|---|---|
| 5,182,600 | A | 1/1993 | Hasegawa et al. | |
| 5,198,861 | A | 3/1993 | Hasegawa et al. | |
| 5,227,842 | A | 7/1993 | Hayashi et al. | |
| 5,237,369 | A | 8/1993 | Maruta et al. | |
| 5,270,783 | A | 12/1993 | Bisaiji et al. | |
| 5,293,198 | A | 3/1994 | Sawayama et al. | |
| 5,327,196 | A | 7/1994 | Kato et al. | |
| 5,387,965 | A | 2/1995 | Hasegawa et al. | |
| 5,630,195 | A | 5/1997 | Sawayama et al. | |
| 5,857,131 | A | 1/1999 | Hasegawa | |
| 5,860,038 | A | 1/1999 | Kato et al. | |
| 5,970,276 | A | 10/1999 | Kato | |
| 6,160,569 | A | 12/2000 | Fujimori et al. | |
| 6,496,677 | B2 | 12/2002 | Fujimori | |
| 6,526,235 | B2 | 2/2003 | Kato | |
| 6,594,453 | B2 | 7/2003 | Kato | |
| 7,062,185 | B2 | 6/2006 | Izumikawa et al. | |
| 2003/0049039 | A1* | 3/2003 | Suzuki | 399/49 |
| 2004/0251435 | A1 | 12/2004 | Sawayama et al. | |
| 2004/0253012 | A1* | 12/2004 | Ishibashi | 399/49 |
| 2005/0019048 | A1 | 1/2005 | Kato | |
| 2005/0147424 | A1 | 7/2005 | Kato et al. | |
| 2005/0207766 | A1 | 9/2005 | Hasegawa et al. | |
| 2006/0002724 | A1 | 1/2006 | Fujimori et al. | |
| 2007/0019976 | A1 | 1/2007 | Watanabe et al. | |

FOREIGN PATENT DOCUMENTS

| | | |
|---|---|---|
| JP | 05-249787 | 9/1993 |
| JP | 06-250480 | 9/1994 |
| JP | 10-221902 | 8/1998 |
| JP | 2001-194843 | 7/2001 |
| JP | 2001-324840 | 11/2001 |
| JP | 2002-072612 | 3/2002 |

OTHER PUBLICATIONS

U.S. Appl. No. 07/691,727, filed Apr. 26, 1991.
U.S. Appl. No. 11/856,304, filed Sep. 17, 2007, Oshige, et al.
U.S. Appl. No. 12/112,525, filed Apr. 30, 2008, Koizumi, et al.
U.S. Appl. No. 12/093,753, filed May 15, 2008, Oshige et al.
U.S. Appl. No. 12/094,198, filed May 19, 2008, Kato et al.

* cited by examiner

IMAGE FORMING METHOD AND APPARATUS WITH IMPROVED CONVERSION CAPABILITY OF AMOUNT OF TONER ADHESION

This application claims priority to Japanese Patent Application No. 2005-193026, filed with the Japanese Patent Office on Jun. 30, 2005, the entire contents of which are hereby incorporated by reference.

FIELD OF INVENTION

The invention generally relates to image forming methods and apparatuses, and more specifically to an image forming method and apparatus capable of implementing improved conversion of the amount of toner or particle adhesion useful for achieving stable image density control in full-color electrophotographic image forming apparatus such as a copying machine and a laser beam printer among others.

BACKGROUND OF INVENTION

In order to implement a stable image density constantly in electrophotographic image forming apparatuses, a toner patch (or, gradation pattern) for detecting the image density is formed conventionally on an image bearing member such as a photoreceptor, for example. The density of the gradation pattern is detected with an optical detecting unit and the potential applied for image development is suitably adjusted according to the results obtained from the detection, which is carried out specifically by changing an LD (laser diode) power, a charging bias, and a developing bias.

As the optical detecting unit for detecting the gradation patterns, a reflection type optical sensor is conventionally known including a light emitting diode (LED) as light source means, and a photodiode (PD) or a phototransistor (PTr) as photoreceptor means.

As the configuration of the optical sensor, there are three types; (A) a first type of the sensor configured to detect only regular reflection light, as illustrated in FIG. 2 (See for example, Japanese Laid-Open Patent Application No. 2001-324840), (B) a second type to detect only diffuse reflection light, as illustrated in FIG. 3 (Japanese Laid-Open Patent Application No. H5-249787 and Japanese Patent Publication No. 3155555), and (C) a third type to detect both regular and reflection light, as illustrated in FIG. 4 (Japanese Laid-Open Patent Application No. 2001-194843).

Reference numerals in FIGS. 2 through 5 are 50A, 50B, and 50C for denoting element holders, 51 for an LED, 52 for a regular reflection photodetector, 53 for a target surface to be detected, 54 a toner gradation pattern on the target surface, and 55 for a diffuse reflection photodetector, respectively.

A fourth type of the sensor (D) illustrated in FIG. 5 has also been used recently, in which a beam splitter is provided on the optical path on both sides of light emission and reception (Japanese Patent Publication No. 2729976 and Japanese Laid-Open Patent Applications No. H10-221902 and 2002-72612).

Reference numerals in FIG. 5 are 56 for denoting an LED, 57 and 58 for beam splitters, 59 for a first photodiode as a light receiving unit for P-wave light (regular reflection light), and 60 for a second photodiode as another light receiving unit for S-wave light (diffuse reflection light), respectively.

As illustrated in the abovementioned disclosures which describe primarily on the formation of color images, a change in the image density leads to a change in hue in the color image forming apparatuses. Therefore, it is important to accurately detect the amount of toner adhered on the gradation patches or patterns in use for detecting density control, in order to stabilize the image density, and properly implement the control according to the results obtained from the detection.

By the above term, "image density" to be stabilized, it is meant the "image density of output image". Conventional monochrome image forming apparatuses perform the detection on the density of photosensitive materials.

By contrast, it is preferable in the color image forming apparatus to perform density detection on the transfer belt immediately before the transfer onto a paper sheet. In addition, since one of the purposes of the present image density control is to implement the control such that the maximum amount of adhesion is brought to a target value, it is desirable for accurate detection be feasible up to the range of high amount of the adhesion.

However, it has been difficult in conventional detection methods to detect the amount of adhesion accurately and constantly over the entire range of the amount of the adhesion.

SUMMARY OF THE INVENTION

Accordingly, it is an object of the invention to provide an image forming method and apparatus having most, if not all, of the advantages and features of similarly employed methods and apparatuses, while reducing or eliminating many of the aforementioned disadvantages.

It is another object to provide an image forming method and apparatus capable of implementing an improved conversion of the amount of toner particle adhesion accurately and constantly over the entire range of the amount of adhesion.

The following description is a synopsis of only selected features and attributes of the present disclosure. A more complete description thereof is found below in the section entitled "Description of the Preferred Embodiments."

The above and other objects of the invention are achieved by providing a method of converting the amount of adhesion, comprising the steps of forming a plurality of gradation powder patterns continuously on the surface to be detected, in which the plurality of gradation powder patterns each have different amount of adhesion;

detecting optically each of the plurality of gradation powder patterns with a sensor configured to simultaneously detect regular reflection light and diffuse reflection light to obtain a regular reflection output voltage and a diffuse reflection output voltage, respectively;

computing a normalization value as a relative output ratio of the regular reflection output voltage to a background regular reflection component from the surface extracted from the regular reflection light;

obtaining a diffuse reflection output conversion factor by subtracting the normalization value multiplied by the diffuse reflection output voltage generated by the surface from the diffuse reflection output voltage, and subjecting the relation between the diffuse reflection output conversion factor and the amount of adhesion in an intermediate adhesion range to a polynomial approximation.

The abovementioned step of obtaining a diffuse reflection output conversion factor may alternatively include subtracting the normalization value multiplied by the diffuse reflection output voltage increment, which is computed as the difference between the diffuse reflection output voltage and another diffuse reflection output voltage obtained when a light emitting device is turned off, from the diffuse reflection output voltage increment, in place of subtracting the normalization value multiplied by the diffuse reflection output voltage generated by the surface from the diffuse reflection output voltage.

According to another aspect, a method is provided for converting the amount of adhesion, comprising the steps of forming a plurality of gradation toner patterns continuously on the surface to be detected, in which the plurality of gradation toner patterns each have different amount of adhesion;

detecting optically each of the plurality of gradation toner patterns with a sensor configured to simultaneously detect regular reflection light and diffuse reflection light to obtain a regular reflection output voltage and a diffuse reflection output voltage, respectively;

computing a normalization value as a relative output ratio of the regular reflection output voltage to a background regular reflection component from the surface extracted from the regular reflection light;

obtaining a diffuse reflection output conversion factor by subtracting the normalization value multiplied by the diffuse reflection output voltage generated by the surface from the diffuse reflection output voltage, and subjecting the relation between the diffuse reflection output conversion factor and the amount of adhesion in an intermediate adhesion range to a polynomial approximation.

The abovementioned step of obtaining a diffuse reflection output conversion factor may alternatively include subtracting the normalization value multiplied by the diffuse reflection output voltage increment, which is computed as the difference between the diffuse reflection output voltage and another diffuse reflection output voltage obtained when a light emitting device is turned off, from the diffuse reflection output voltage increment, in place of subtracting the normalization value multiplied by the diffuse reflection output voltage generated by the surface from the diffuse reflection output voltage.

The present embodiment of the invention is therefore characterized by providing an algorithm for approximating, by a polynomial expression, the relation between the diffuse reflection output and the amount of adhesion in the intermediate range of adhesion.

According to still another aspect, based on the relation of the polynomial approximation between the regular reflection output conversion factor, as normalization value of regular reflection component in the regular reflection light, having a linear relation with the amount of adhesion, and the diffuse reflection output conversion factor; the diffuse reflection output conversion factor is uniquely converted to a value of the amount of adhesion by multiplying a correction factor such that a first certain value of the diffuse reflection output conversion factor obtained by converting a second certain value of the regular reflection output conversion factor is brought to be equal to a third certain value.

This embodiment of the invention is therefore characterized by providing an algorithm for converting the diffuse reflection output conversion uniquely to the value of the amount of adhesion.

According to another aspect, based on the relation of the polynomial approximation between the regular reflection output conversion factor, as normalization value of regular reflection component in the regular reflection light, having a linear relation with the amount of adhesion, and the diffuse reflection output conversion factor; the diffuse reflection output conversion factor is converted to a value of the amount of adhesion by multiplying a correction factor such that a first certain value of the diffuse reflection output conversion factor obtained by converting a second certain value of the regular reflection output conversion factor is brought to be equal to a third certain value, and by converting the diffuse reflection output conversion factor multiplied by the correction factor according to either an expression or a reference table formed beforehand between the adhesion amount of adhesion and the diffuse reflection output conversion factor.

According to another aspect, an image forming apparatus is provided being capable of performing at least anyone of the methods of converting the amount of adhesion, described above.

These and other features and advantages of the invention will be more clearly seen from the following detailed description of the invention which is provided in connection with the accompanying drawings.

BRIEF DESCRIPTION OF THE DRAWINGS

In the following drawings, like reference numerals will be used to refer to like elements, in which.

DETAILED DESCRIPTION OF PREFERRED EMBODIMENTS

Figure 1:
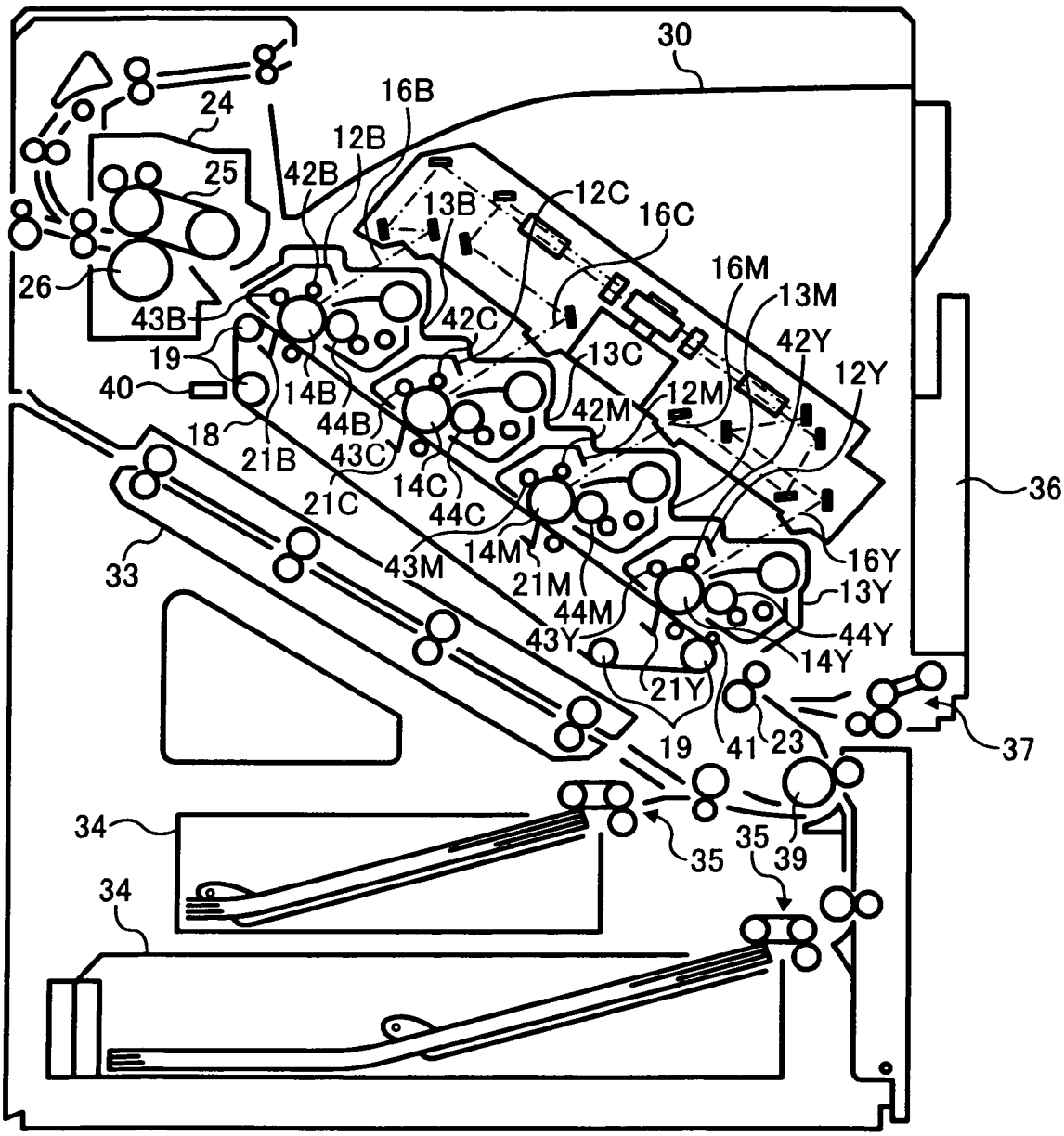
FIG. 1 is a diagrammatic frontal view illustrating the four-chambered tandem type direct transfer full-color image forming apparatus of the invention.

In the detailed description which follows, specific embodiments are described on an image forming method and apparatus capable of implementing improved conversion of the amount of toner adhesion.

It is understood, however, that the present disclosure is not limited to these embodiments. For example, it is appreciated that the present conversion method may also be adaptable to a variety of other methods and apparatuses. Other embodiments will be apparent to those skilled in the art upon reading the following description.

In addition, in the description that follows specific terminology is used in many instances for the sake of clarity. However, the disclosure of this patent specification is not intended to be limited to the specific terminology so selected and it is to be understood that each specific element includes all technical equivalents that operate in a similar manner.

According to a first embodiment of the invention, there provided is a method of converting the amount of adhesion, comprising the steps of forming a plurality of gradation powder patterns, detecting optically each of the plurality of gradation powder patterns, computing a normalization value, obtaining a diffuse reflection output conversion factor, and subjecting the relation between the diffuse reflection output conversion factor and the amount of adhesion to a polynomial approximation.

The abovementioned step of forming a plurality of gradation powder patterns includes forming the patterns continuously on the surface to be detected, in which the plurality of gradation powder patterns each have different amount of adhesion;

the step of detecting optically each of the plurality of gradation powder patterns includes detecting with a sensor configured to simultaneously detect regular reflection light and diffuse reflection light to obtain a regular reflection output voltage and a diffuse reflection output voltage, respectively;

the step of computing a normalization value includes computing at least one normalization value as a relative output ratio of the regular reflection output voltage to a background regular reflection component from the surface extracted from the regular reflection light;

the step of obtaining a diffuse reflection output conversion factor includes subtracting the normalization value multiplied by the diffuse reflection output voltage generated by the surface from the diffuse reflection output voltage; and the step of subjecting the relation between the diffuse reflection output conversion factor and the amount of adhesion to a polynomial approximation is implemented in an intermediate adhesion range.

In the method mentioned just above, the step of obtaining a diffuse reflection output conversion factor may alternatively include subtracting the normalization value multiplied by the diffuse reflection output voltage increment, which is computed as the difference between the diffuse reflection output voltage and another diffuse reflection output voltage obtained when a light emitting device is turned off, from the diffuse reflection output voltage increment, in place of subtracting the normalization value multiplied by the diffuse reflection output voltage generated by the surface from the diffuse reflection output voltage.

According to a second embodiment of the invention, there provided is a method of converting the amount of adhesion, comprising the steps of forming a plurality of gradation toner patterns, detecting optically each of the plurality of gradation toner patterns, computing a normalization value, obtaining a diffuse reflection output conversion factor, and subjecting the relation between the diffuse reflection output conversion factor and the amount of adhesion to a polynomial approximation.

The abovementioned step of forming a plurality of gradation toner patterns includes forming the patterns continuously on the surface to be detected, in which the plurality of gradation toner patterns each have different amount of adhesion; the step of detecting optically each of the plurality of gradation toner patterns includes detecting with a sensor configured to simultaneously detect regular reflection light and diffuse reflection light to obtain a regular reflection output voltage and a diffuse reflection output voltage, respectively; the step of computing a normalization value includes computing at least one normalization value as a relative output ratio of the regular reflection output voltage to a background regular reflection component from the surface extracted from the regular reflection light; the step of obtaining a diffuse reflection output conversion factor includes subtracting the normalization value multiplied by the diffuse reflection output voltage generated by the surface from the diffuse reflection output voltage; and the step of subjecting the relation between the diffuse reflection output conversion factor and the amount of adhesion to a polynomial approximation is implemented in an intermediate adhesion range.

In the method mentioned just above, the step of obtaining a diffuse reflection output conversion factor may alternatively include subtracting the normalization value multiplied by the diffuse reflection output voltage increment, which is computed as the difference between the diffuse reflection output voltage and another diffuse reflection output voltage obtained when a light emitting device is turned off, from the diffuse reflection output voltage increment, in place of subtracting the normalization value multiplied by the diffuse reflection output voltage generated by the surface from the diffuse reflection output voltage.

Therefore, the first and second embodiments of the invention are characterized by providing an algorithm for approximating, by a polynomial expression, the relation between the diffuse reflection output and the amount of adhesion of powder or toner in the intermediate range of adhesion, respectively.

In the first and second embodiments of the invention, it is additionally configured, based on the relation of the polynomial approximation between the regular reflection output conversion factor, as normalization value of regular reflection component in the regular reflection light, having a linear relation with the amount of adhesion, and the diffuse reflection output conversion factor; that the diffuse reflection output conversion factor is uniquely converted to a value of the amount of adhesion by multiplying a correction factor such that a first certain value of the diffuse reflection output conversion factor obtained by converting a second certain value of the regular reflection output conversion factor is brought to be equal to a third certain value.

In addition, it may alternatively be configured in the first and second embodiments of the invention, based on the relation of the polynomial approximation between the regular reflection output conversion factor, as normalization value of regular reflection component in the regular reflection light, having a linear relation with the amount of adhesion, and the diffuse reflection output conversion factor; the diffuse reflection output conversion factor is converted to a value of the amount of adhesion by multiplying a correction factor such that a first certain value of the diffuse reflection output conversion factor obtained by converting a second certain value of the regular reflection output conversion factor is brought to be equal to a third certain value, and by converting the diffuse reflection output conversion factor multiplied by the correction factor according to either an expression or a reference table formed beforehand between the adhesion amount of adhesion and the diffuse reflection output conversion factor.

These additional configurations are therefore characterized by providing an algorithm for converting the diffuse reflection output conversion uniquely to the value of the amount of adhesion.

Still in addition, it may additionally be configured in the first and second embodiments of the invention that lightness of the surface is equal to, or smaller than 20.

It may be added that the point of reference for performing a sensitivity correction in these embodiments, as a certain regular reflection output conversion value with which the correction factor is multiplied so that the diffuse reflection output conversion value with respect to the certain regular reflection output conversion value becomes the third certain value, is in a range where the detection of the amount by regular reflection light is feasible.

Alternatively, the point of reference for performing a sensitivity correction may be in the range of the amount of adhesion equal to, or smaller than four-fifths of the value of the amount of adhesion which corresponds to the normalization value of approximately zero.

According to a third embodiment, an image forming apparatus is provided being capable of performing at least anyone of the methods of converting the amount of adhesion, described above.

Having described the present disclosure in general, several preferred embodiments of the method of converting the amount of toner adhesion will be described herein below according to the present invention in reference to FIGS. 1 through 35.

In the first place, before detailing the configuration and the function in this embodiment, the circumstances for realizing the present invention will be described.

[Examination on Configuration and Function of Optical Detection Means]

When it is considered which type of optical sensors is used for detecting the density gradation pattern on the transfer belt serving as the target face for detection, (A) in a first type of the sensor configured to detect only the regular reflection light, there is a drawback in that the detection up to the high adhesion range is not feasible, and (B) in a second type of the sensor configured to detect only the diffuse reflection light, and if the transfer belt is black in color (since the transfer belt is often formed so because of carbon included therein as a resistance modifier), there is another drawback in that the black toner cannot be detected, and there is a more serious shortfall in that the calibration of sensor sensitivity cannot be feasible since the diffuse reflection output from the background of the black transfer belt is substantially zero.

In order to obviate such problems, several disclosures are made such as (C) a third type of sensor unit, in which a difference in outputs between two photosensors is calculated by using both regular reflection light and the diffuse reflection light (See, for example, Japanese Patent Publication No. 3155555 and Japanese Laid-Open Patent Application No. 2001-194843), and (D) a fourth type of sensor unit, in which a ratio is calculated between two photosensors (Japanese Laid-Open Patent Application No. H10-221902).

However, in the above mentioned conventional detection methods of (C) and (D) for detecting both regular reflection light and the diffuse reflection light, it is difficult to detect always the adhesion amount stably and accurately owning to the following reasons; (1) The difference in output characteristics of light emitting diode output and the photodetector from one production lot to another is not properly taken into consideration (scattering in sensor characteristics), (2) temperature characteristics and the change over time for the devices are not taken into consideration (variation in sensor characteristics), and (3) the deterioration over time of the transfer belt serving as the target face to be detected is not sufficiently considered (changes in the belt conditions).

Those points are further examined herein below.

In order to study how much scattering exists between sensor elements, the magnitude of the scattering is obtained by the output measurements of several lots of LED (light emitting diode) devices and PTr (phototransistor) devices according the following methods, in which manufacturing lots each includes 197 devices.

Figure 2:
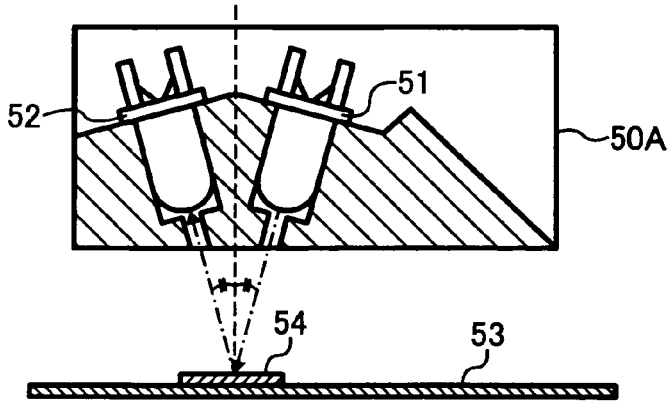
FIG. 2 PRIOR ART
FIG. 2 is a schematic diagram illustrating a first type of optical detection unit detecting only regular reflection light.
Figure 3:
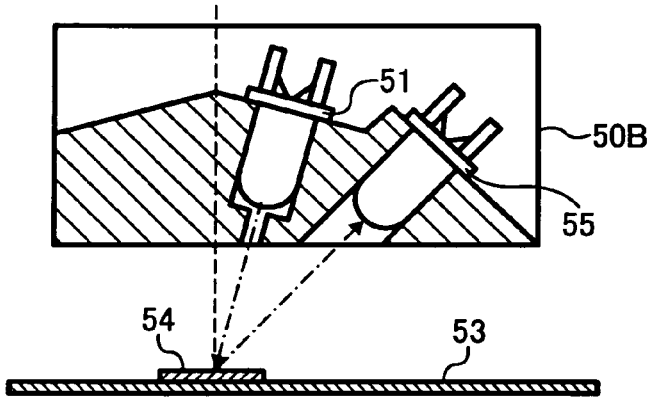
FIG. 3 PRIOR ART
FIG. 3 is a schematic diagram illustrating a second type of optical detection unit detecting only diffuse reflection light.

By using the sensor head illustrated in FIG. 2, the light emitting diodes are sequentially changed under the conditions of Vcc=5 volts, LED current If=14.2 mA (milliamp) and photodetector conditions being fixed. The values of photocurrent IL of the photodetector are then measured during the reception of the light reflected from the surface of a predetermined reference board, whereby the magnitude of light emission is determined.

In addition, by using the sensor head illustrated in FIG. 2, the photodetectors are sequentially changed under the conditions of Vcc=5 volts, LED current If=14.2 mA (milliamp) and light emitting diode conditions being fixed. The values of photocurrent IL of the photodetector are measured during the reception of the light reflected from the surface of a predetermined reference board, whereby the magnitude of photoreceptor sensitivity is determined.

The results obtained from the measurements are shown in Table 1.

TABLE 1

Scattering of Sensor Characteristics

| | Scattering | | |
|---|---|---|---|
| | Lower limit | Upper limit | Ratio (Upper/Lower) |
| Light emitting device | 110 μA | 200 μA | 1.8 |
| Photoreceptor device | 71 μA | 268 μA | 3.8 |

The results illustrated in Table 1 indicate that there exists an output difference of slightly less than twice for the light emitting diode, and slightly less than four times for the photodetector.

Although the magnitude of the scattering may be different depending on the device type (for example, top-view or side-view type) and manufacturer, it is considered that the scattering exists for any device to a certain degree, whereby at least some adjustments are required.

In regard to the point mentioned just above, no description is found in those disclosures. This may be due to the recognition of making so-called as a matter of course out of the above point. However, in order to implement accurate measurements of the adhesion amount, strict output adjustment of the sensor devices is desirable at the stage of outgoing inspection.

Plausible outcome will be described herein below based on the experimental data in the case where no adjustment is made.

Figure 4:
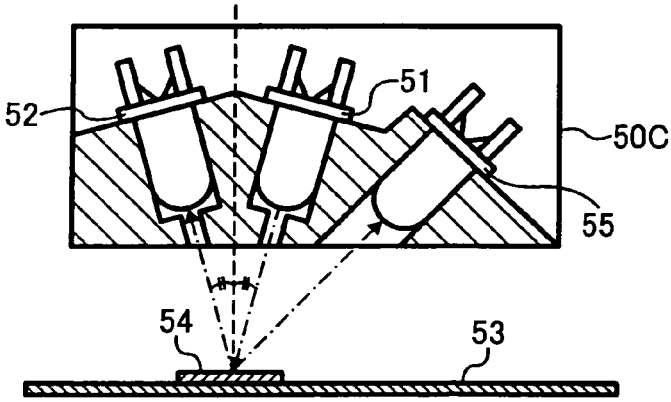
FIG. 4 PRIOR ART
FIG. 4 is a schematic diagram illustrating a third type of optical detection unit detecting both regular and reflection light.
Figure 5:
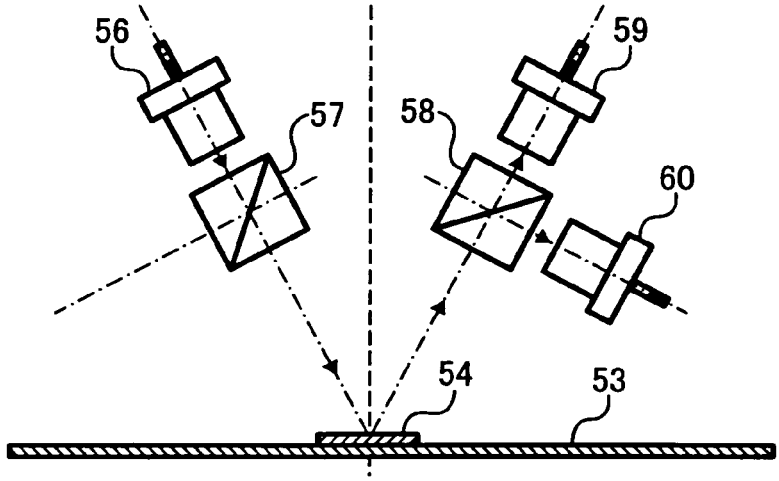
FIG. 5 PRIOR ART
FIG. 5 is a schematic diagram illustrating a fourth type of optical detection unit provided with beam splitters on the optical path on both sides of light emission and reception.
Figure 6:
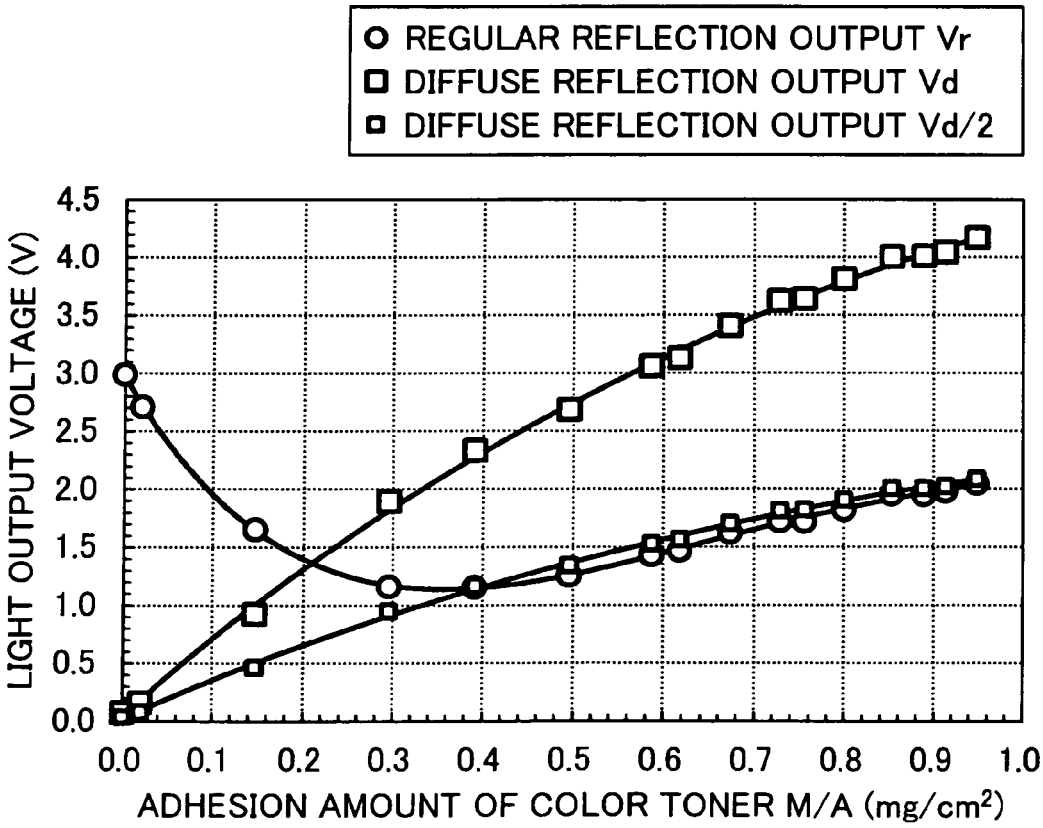
FIG. 6 illustrates the results obtained from the measurements of the amount of color toner adhesion on the transfer belt measured by the sensor of FIG. 4, which plots the adhesion amount, horizontally, versus the light output voltage, vertically, for the regular reflection and diffuse reflection.

FIG. 6 illustrates the results obtained from the measurements of the amount of color toner adhesion on the transfer belt measured by the sensor of FIG. 4, which plots the adhesion amount, horizontally, versus the light output voltage, vertically, for the regular reflection and diffuse reflection.

Even in this case where the scattering is found for both the regular reflection photodetector and the diffuse reflection photodetector, there is such a characteristic that the output becomes the largest from the background (or ground face) at least in the regular reflection output. By adjusting the LED current such that the output from the background reaches a certain value (3.0 volts, in this case), therefore, the output difference due to the scattering of device characteristics for the light emitting diodes and the regular reflection photodetector can be absorbed. As a result, substantially unique output characteristics can be obtained as the sensor output with respect to the adhesion amount.

Large square marks in FIG. 6 denote the points graphically plotting the diffuse reflection output after the LED adjustment.

Assuming the case where the magnitude of scattering of two times for the photodetector characteristics and one half time for the photodetector sensitivity, the resulting plot is obtained as denoted by small square marks corresponding to Vd/2 outputs of FIG. 6. Moreover, when the difference is calculated between the regular reflection light (Vr) and the Vd/2 output, it is clearly shown, as illustrated in FIG. 6, that the relation between the output and the adhesion amount cannot uniquely be determined. This is also true in the case of the output ratio in place of the difference above mentioned.

Figure 7:
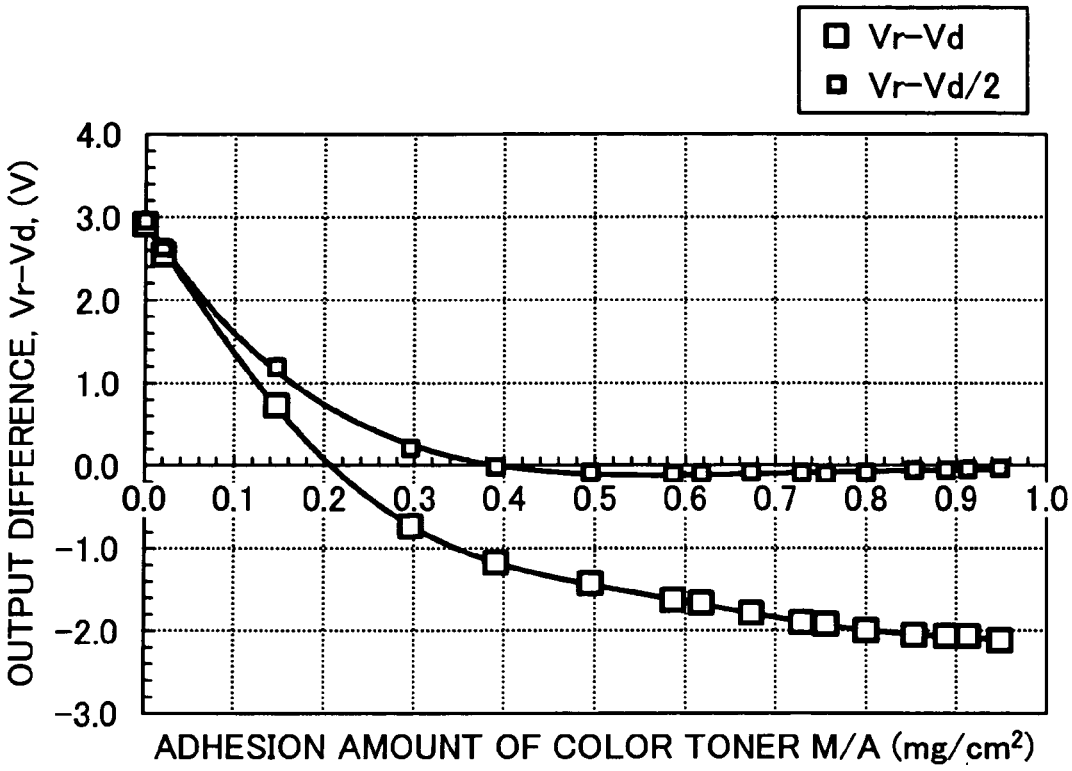
FIG. 7 illustrates the results obtained from the measurements, which plots the amount of color toner adhesion, horizontally, versus the difference between the regular reflection output and the diffuse reflection output, vertically.

In addition, as illustrated in FIG. 7, when the values of two conditions agree with each other at a point where the adhesion amount is zero and do not agree in the region of higher amounts, the output relation with respect to the adhesion amount cannot uniquely be determined, even if known calculation such as the normalization processing of the regular reflection output is performed.

Therefore, when the step of adhesion amount conversion is intended based on data of the difference or ratio from the "regular reflection output" and the "diffuse reflection output", the relation between the "regular reflection output" and the "diffuse reflection output" preferably satisfies a certain relation continually.

Accordingly, the correction of scattering is desirable, which is carried out on sensor device characteristics at the stage of outgoing inspection by strictly adjusting, for example, the relation between the regular reflection output and the diffuse reflection output with respect to a certain reference illumination plate.

Moreover, even after the abovementioned adjustment is made according to the techniques previously known, accurate adhesion amount cannot be obtained by only calculating the difference or the ratio, owning to other variable factors mentioned earlier such as (2) the variation in sensor characteristics over time, and (3) the deterioration of the transfer belt over time.

In regard to the factor (3), a description will be made herein below.

Since the transfer belt during image formation always comes into contact with a transfer paper sheet serving as the recording medium, the belt surface becomes rough due to fractional wear. In addition, in the case when the transfer sheets continuously fed during the image formation each containing a whitening composition, the belt surface becomes whitened with the lapse of time.

Prior to presenting experimental results, the factors will be discussed that have influence on the change in the regular reflection output and the diffuse reflection output.

The regular reflection output refers to the light mirror-reflected on the target surface (the angle of incidence with normal is equal to the angle of reflection with normal). When the target surface for detection is slick and shiny (i.e., high in gloss level), as illustrated in FIG. 8, the incident light 61 is diffused only slightly by the detection target surface 53, while almost all thereof is mirror-reflected as the regular reflection light 62.

Figure 8:
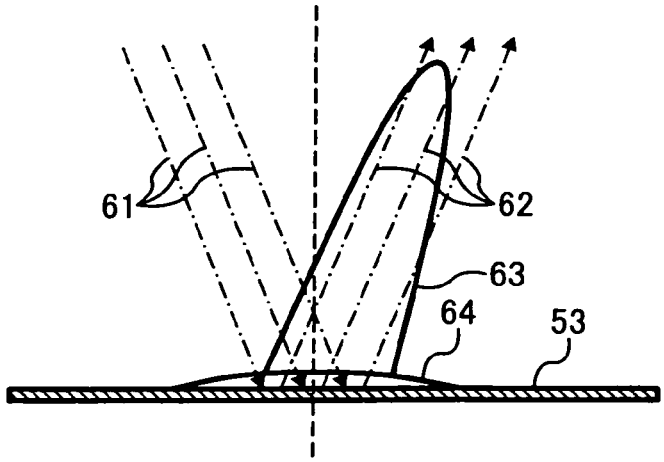
FIG. 8 illustrates the reflection and diffusion of the incident light onto a surface with a high mirror gloss, which is diffused only slightly, while almost all of light is mirror-reflected as the regular reflection light.

The numerals 63 and 64 of FIG. 8 designate, therefore, the distribution pattern of the light sensitivity for the regular reflection and the diffuse reflection, respectively.

Figure 9:
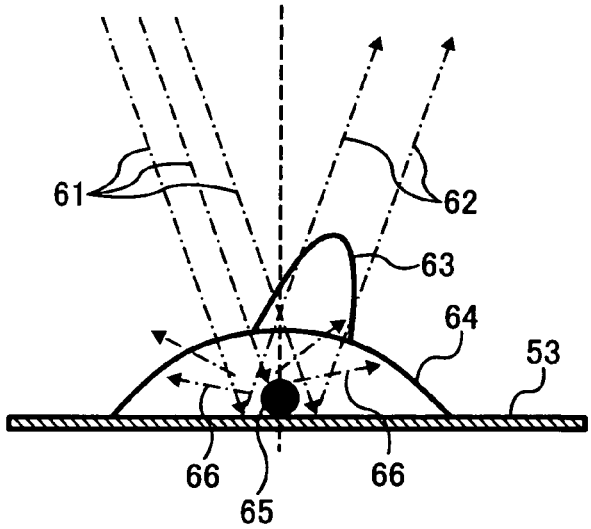
FIG. 9 illustrates the reflection and diffusion of the incident light onto a surface with a decreased mirror gloss caused by the adhesion of toner, which is diffused considerably.

If toner 65 as a powder material adheres onto the detection target surface 53, as illustrated in FIG. 9, the incident light 61 is diffused more by the toner 65. As a result, the regular reflection light 62 decreases, while the diffuse reflection light 66 increases.

While the abovementioned increase takes place for color toner, it should be noted that the incident light 61 is substantially absorbed in the case of black toner and hence the diffuse reflection light 66 hardly increases.

That is, for the regular reflection light, the output changes with the "change of state of the surface characteristics (gloss level, surface roughness, and other similar factors)" of the target object to the detected. By contrast, the output for the diffuse reflection light changes with the "change of color characteristics (lightness and the like)" of the object to the detected.

Thus, it is considered that the output changes for the regular and diffuse reflections are caused by respective factors substantially different with each other.

In the next place, the results obtained from experimentation will be described in regard to the deterioration of the transfer belt over time.

In the four-chambered tandem type direct transfer full-color image forming apparatus illustrated in FIG. 1, it is assumed that the surface of the transfer belt becomes roughened and whitened with the lapse of time, and 16 gradation patterns are formed on three types of transfer belts each having different "specular (regular) gloss level (Gs)" and "lightness (L*)", to make an estimate of light outputs as the results of the change in these patterns with the lapse of time by comparing sensor outputs on detecting these patterns.

Various conditions for the experiment are as follows.

<Transfer Belt (as the Target Surface to be Detected)>

Black belt:

Specular gloss level Gs(60)=57 and Lightness L*=10,

Brown belt:

Specular gloss level Gs(60)=27 and Lightness: L*=25,

Grey belt:

Specular gloss level Gs(60)=5 and Lightness: L*=18.

<Detector (Optical Detecting Means)>

Detailed Specification of the Sensor of FIG. 4.

Light Emitting Device:

GaAs infrared LED of top-view type with peak emission at $\lambda p$=950 nanometers in wavelength and spot diameter of $\phi$=1.0 millimeter.

Photodetector:

Si phototransistor of top view type with peak spectral sensitivity at $\lambda p$=800 nanometers) and spot diameters of $\phi$=1.0 and 3.0 millimeter for receiving the regular reflection and diffuse reflection, respectively.

<Linear Velocity> 125 millimeters per second.

<Sampling Frequency>

500 samplings per second (every 2 millisecond).

Note 1: The value of specular gloss level was measured with Gloss meter Model PG-1 manufactured by Nippon Denshoku, and the measurement was made at a measurement angle of 60 degrees.

Note 2: Lightness was measured with Spectrophotometric Calorimeter Model X-Rite 938 manufactured by X-Rite, and the measurement was made at a view angle of 2 degrees and using D50 light source.

Figure 10:
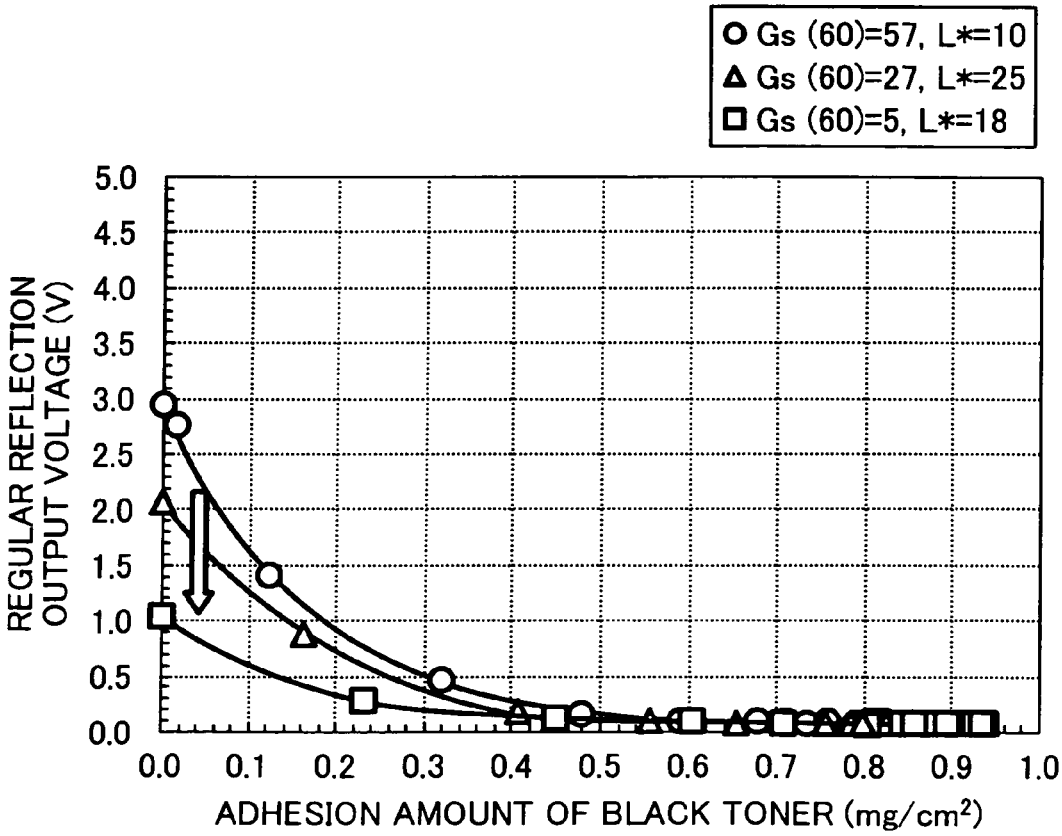
FIG. 10 illustrates regular reflection output characteristics plotting the regular reflection output, vertically, versus the adhesion amount, horizontally, for the transfer of black toner.
Figure 11:
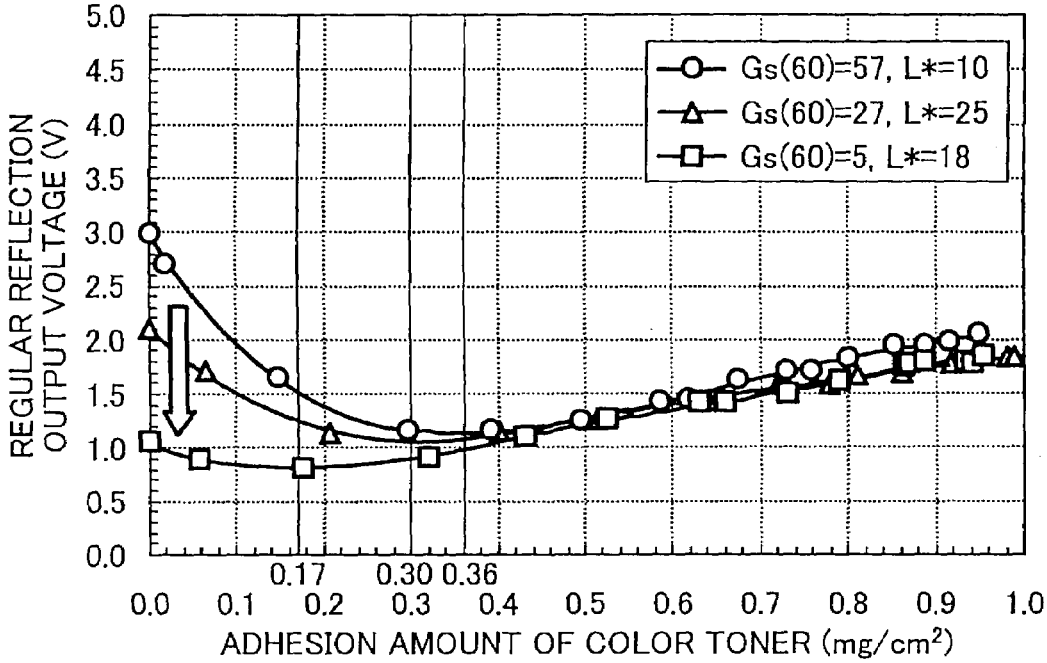
FIG. 11 illustrates regular reflection output characteristics plotting the regular reflection output, vertically, versus the adhesion amount, horizontally, for the transfer of color toner.

The results are shown in FIGS. 10 and 11 which plot the regular reflection output characteristics, vertically, versus the adhesion amount, horizontally, for the transfer of black toner and color toner, respectively.

The measurements were made herein under the condition of fixed light emission (LED current If is fixed to 25 milliamps). As a result, in the high adhesion amount range (M/A is 0.4 mg/cm$^2$ or greater) where no influence of the belt background is found, the data on the regular reflection output (voltage) for three kinds of transfer belts substantially agree with each other. In contrast, in the low adhesion amount range (less than 0.4 mg/cm$^2$) where the influence from the belt background is evident, the data do not agree with each other for the three kinds of belts.

Therefore, when the specular gloss level of the transfer belt decreases with the lapse of time, that is, when the roughening of belt surface progresses, it is indicated from the results, as shown by the arrow in the drawing, that the regular reflection output decreases in the low transfer range where a comparatively larger portion of the belt background is exposed.

[Examination on Drawbacks Encountered with the Known Type A Sensor]

It is also indicated from the results obtained from the above noted experiments, one of major difficulties in the case when the detection of adhesion amount is performed by using the type A sensor configured to detect only the regular reflection output is that, in the color toner detection, the detectable range of adhesion amount decreases with the lapse of time, with a decrease in the gloss level of the transfer belt.

The reason for this difficulty is considered due to the fact that the adhesion amount cannot be properly detected for the range larger than the point of inflection in the sensor output versus amount characteristics illustrated in FIG. 11, as a result of the following adhesion amount detection algorithm which has been conventionally in use for the adhesion amount detection. That is, the "Conventional Adhesion Amount Detection Conversion Formula for Regular Reflection Output" is expressed by (Output voltage from image pattern portion−Vmin)/
(Output voltage from background portion−
Vmin), where Vmin is the minimum of plural outputs from the image pattern portion.

When the minimum output values of the respective belts are determined from the point of inflection of the approximation curves, the detectable maximum adhesion amount decreases, as indicated in FIG. 11, from 0.36 (57) to 0.30 (27), and 0.17 (5) with the belt deterioration for respective specular gloss levels included in the parentheses.

It may be added that the range available for determining the proper adhesion amount is defined herein as the range up to the value corresponding to the inflection point.

In addition, with respect to the detection of the black toner adhesion amount, the detection accuracy slightly decreases with the decrease in SN ratio. However, the determination of the adhesion amount is still possible for the black toner without appreciable change in the detectable maximum adhesion amount.

Figure 12:
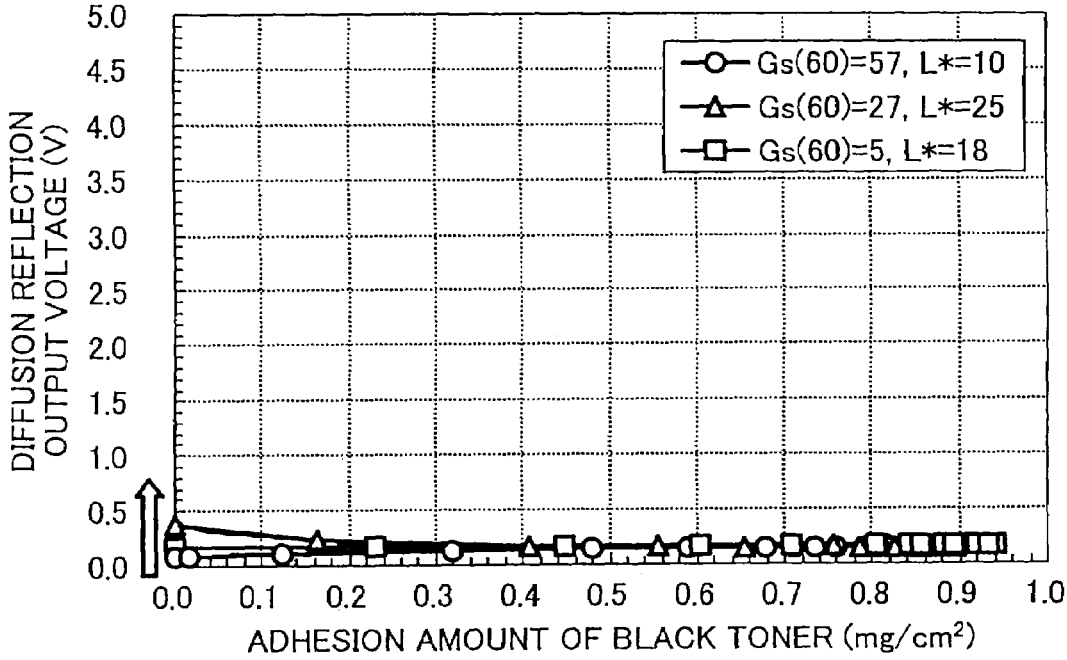
FIG. 12 illustrates diffuse reflection output characteristics plotting the diffuse reflection output, vertically, versus the adhesion amount, horizontally, for the transfer of black toner.
Figure 13:
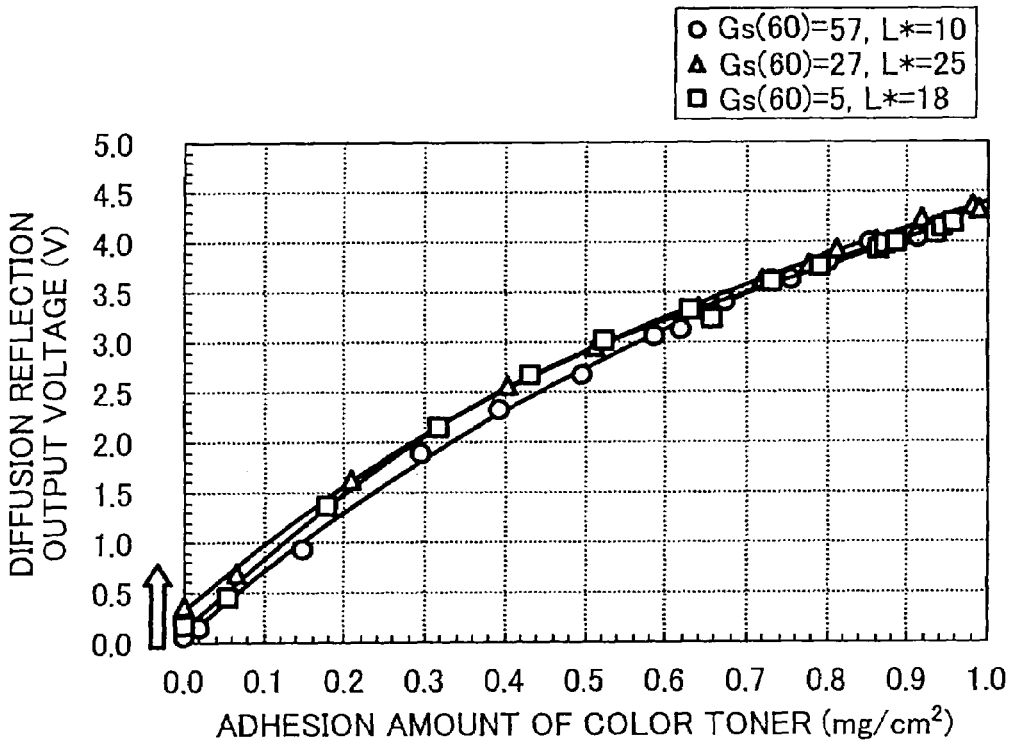
FIG. 13 illustrates diffuse reflection output characteristics plotting the diffuse reflection output, vertically, versus the adhesion amount, horizontally, for the transfer of color toner.

In the next place, the results of the diffuse reflection output are shown in FIGS. 12 and 13 which plot the diffuse reflection output characteristics, vertically, versus the adhesion amount, horizontally, for the black toner and color toner, respectively.

Although the data on the diffuse reflection output in the high adhesion amount range substantially agree with each other for three kinds of transfer belts without appreciable influence of the belt background, the data do not agree with each other in the low adhesion amount range where the influence of the change in lightness of the belt background.

That is, it is indicated that when the transfer belt is whitened over time, the diffuse reflection output in the transfer belt background increases.

[Examination on Drawbacks Encountered with the Known Type B Sensor]

It is considered from the results obtained by the above noted experiments that several difficulties are encountered when the detection of adhesion amount is performed by using the type B sensor capable of detecting only the diffusion reflection output, in that (1) this type of sensor does not have a means for correcting the change in characteristics of the target surface for the detection over time, and (2) when the target surface is black in color as with the lightness L* of less than 20, the sensitivity calibration for the sensor cannot be performed on the target surface.

The reason for the latter difficulty with the lightness L* of less than 20 is considered due to the fact that the diffuse reflection output from the background becomes substantially zero.

For reference purposes, the method of sensitivity calibration for the sensor will be described, which is adopted by the present inventors with a conventional machine.

Namely, after installing a sensor on an image forming apparatus in the factory, the current of LED element on the light emission side of the sensor is adjusted such that the sensor output with respect to a white reference plate reaches a certain value.

Although such initial adjustment is achieved by this method, it should be added that the correction over time cannot be assured by this method since the sensor is not provided with the capabilities of correcting over-time changes regarding LED outputs and temperature characteristics of the sensor devices.

Figure 14:
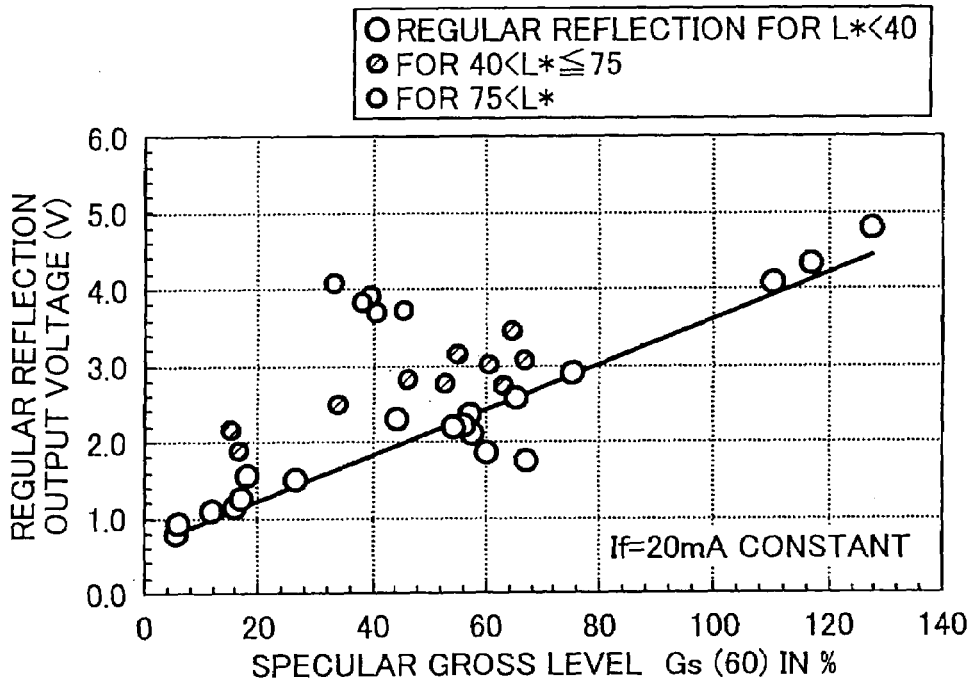
FIG. 14 illustrates experimental results on the correlation between specular gloss level and the regular reflection output.
Figure 15:
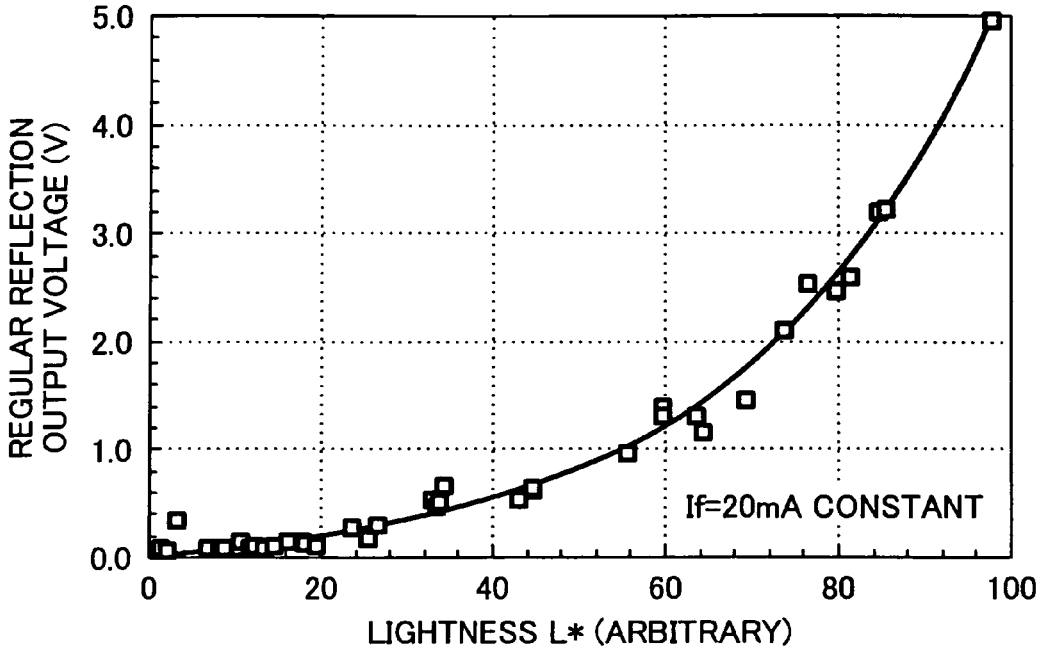
FIG. 15 illustrates the results on the correlation between the lightness and the diffuse reflection output, plotting the diffuse reflection results obtained from the measurements, vertically, versus the lightness of the belt, horizontally.

FIG. 14 illustrates experimental results on the correlation between specular gloss level and the regular reflection output. FIG. 15 illustrates the results on the correlation between the lightness and the diffuse reflection output.

FIG. 14 plots the results of the regular reflection outputs, vertically, versus specular gloss level with percent values with respect to 60 degrees gloss level, horizontally, in which the regular reflection outputs were obtained from 42 transfer belts each having different values of "gloss level" and "lightness" with LED emissions at a fixed current of 20 milliamp and a reflection type photosensor illustrated in FIG. 4.

In addition, specular gloss level values were obtained with Gloss meter Model PG-1 manufactured by Nippon Denshoku from the measurement at an angle of 60 degrees.

By taking the aforementioned results into consideration, in that the regular reflection output contains diffuse reflection components, as illustrated earlier in FIG. 9, the present results of the substantially linear relationship of FIG. 14 can be understood between the regular reflection output voltage and the gloss level, which is observed for the output results sorted out for each range of lightness.

This is because of the fact that the regular reflection light itself is measured with respect to the specular gloss level (for example, see JISZ8741 on Specular gloss level-measurement method).

The diffuse reflection outputs were also measured at the same time and FIG. 15 plots the diffuse reflection results obtained from the measurements, vertically, versus the lightness of the belt, horizontally, in which the notation [−] indicates arbitrary in unit.

In addition, the lightness was measured with Spectrophotometric Calorimeter Model X-Rite 938 manufactured by X-Rite using D50 light source at a view angle of 2 degrees.

Although the relation observed herein above is not linear between the diffuse reflection outputs and the lightness due to the difference in the light source and the measurement angle, the data points are plotted substantially on one single curve without being affected by the gloss level as shown in FIG. 15. It is indicated from the results that the diffuse reflection output is independent of the regular reflection output.

In the case when there encountered is at least one of (1) the surface of the transfer belt becomes rough with the lapse of time and the regular reflection output from the background of the belt decreases, and (2) the surface of the transfer belt is whitened to increase the diffuse reflection output from the background, the initial relationship between "regular reflection output" and "diffusion reflection output" does not hold any longer, and accordingly the output cannot be reduced to the same state as the initial by simply computing either the difference or the ratio between the two outputs.

Therefore, even if the adhesion amount conversion is performed based on the results obtained from the calculation mentioned above, the result conforming to the initial state can never be obtained. In addition, if the computation is performed such that the results are directly fed back to the density control means before completing the step of adhesion amount conversion, the results will be obtained deviated from those corresponding to the initial state.

Therefore, when the regular reflection output decreases due to degradation of the gloss level of the belt, a step for the correction by increasing the LED current may be contemplated.

Figure 16:
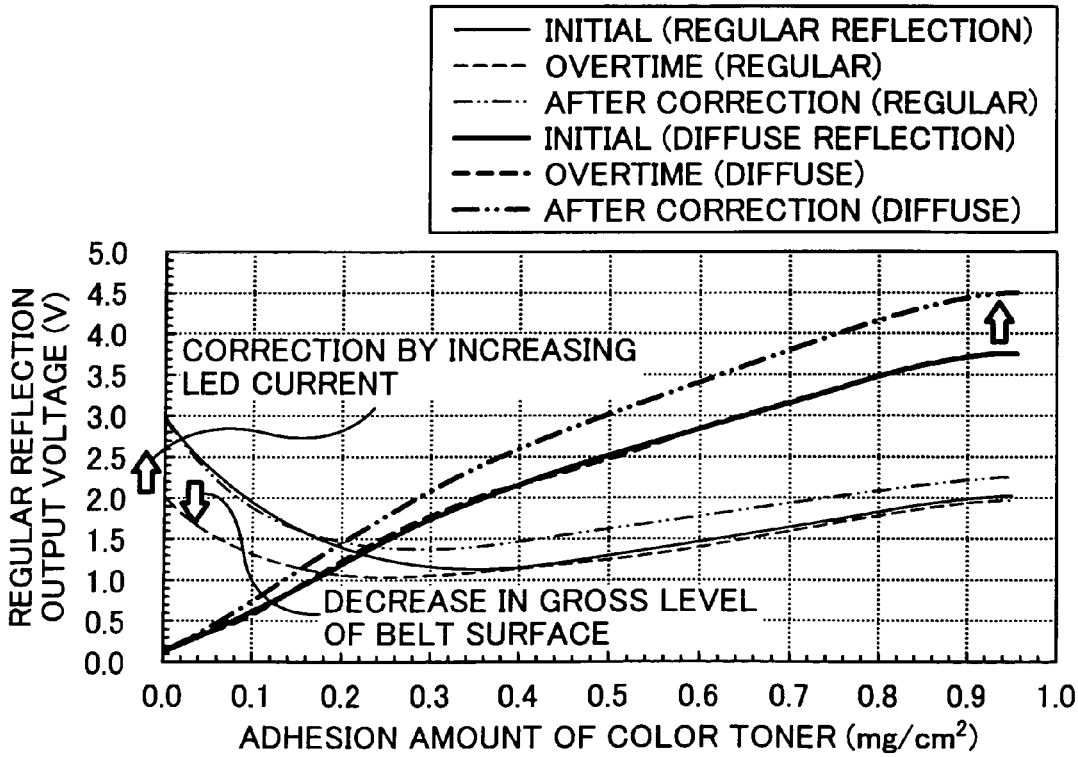
FIG. 16 illustrates the results of the overtime decrease in gloss, which plots the amount of color toner adhesion, horizontally, versus the regular reflection output, vertically, indicating the effects of correction provided.
Figure 17:
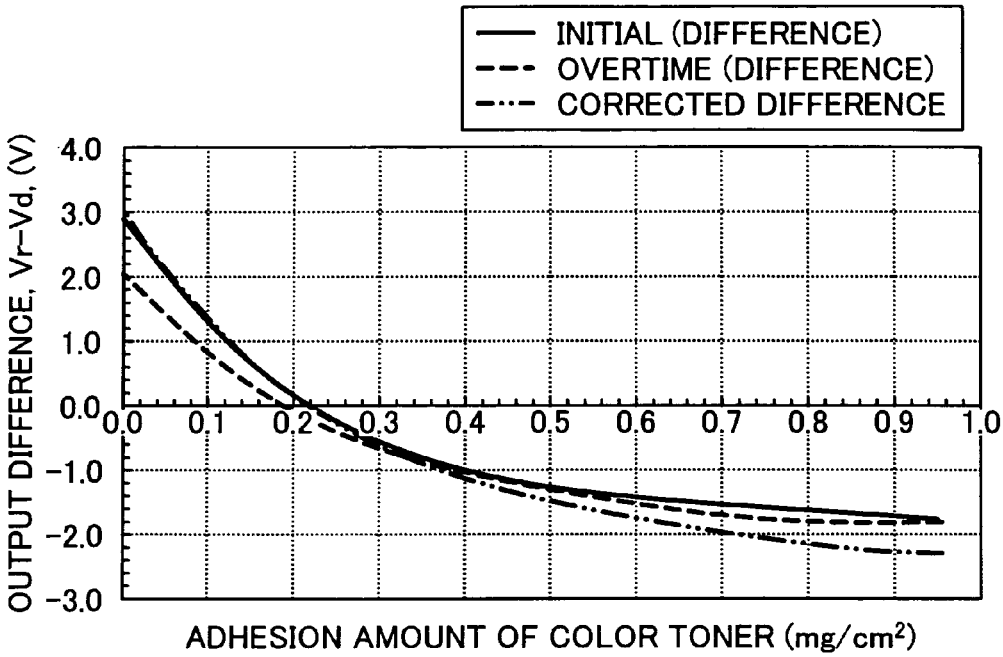
FIG. 17 illustrates the results of the overtime decrease in gloss, which plots the amount of color toner adhesion, horizontally, versus the difference between the regular reflection output and the diffuse reflection output, vertically.

In this case, if the adjustment is performed so that the regular reflection output from the background is brought to the initial value, at least the value from the background can be made to coincide with the initial value. However, this leads to the increase in the output for the color toner over the whole range as illustrated in FIG. 16. Furthermore, the diffuse reflection output voltage increases with increasing the intensity of the light received.

Although the output difference resulting from the above noted correction may be brought to coincide with the initial values in the low adhesion range as illustrated in FIG. 16, a deviation occurs in the high transfer area.

Therefore, the same results as those corresponding to the initial state cannot be obtained in this case as well, and this difficulty persists not only for the abovementioned output difference but also for the output ratio.

Among the aforementioned reasons for the difficulty to detect always the adhesion amount stably and accurately, the second reason, or (2) temperature characteristics and the change over time for the devices (variation in sensor characteristics), is considered in similar manner as above.

Namely, even in the case where there is no change over time, a change due to the increase in ambient temperature may takes place in the output characteristics of a semiconductor device such as the light emitting diode and the photodetector in the present case. In such a case, the outputs obtained with the sensors are also deviated from the initial values as a result of similar reasons as those mentioned above for (1) the scattering in sensor characteristics from one production lot to another.

As described above, with regard to the methods using the conventional technique, which is proposed as a solution for the adhesion amount detection in the high adhesion range, in particular, the detection of the adhesion amount of toner up to the high adhesion range on the black transfer belt which is frequently used in the full-color image forming apparatus, (a) it is considered highly prerequisite for properly utilizing the gradation pattern detection technique that toner density detection sensors are precisely adjusted in advance, that is, strict adjustments are performed at the stage of outgoing inspection.

In addition, it is also considered that (b) any measure has not been taken with respect the over-time change and the environmental change of the density detection sensor, and (c) neither any measure to the over-time change of the transfer belt as the target surface for the detection. Therefore, it can be said that technical problems have been accumulated yet to be solved regarding the method of detection utilizing the gradation patterns.

In other words, several points has come to emerge as the technical subjects yet to be solved regarding the method of constantly detecting the adhesion amount of toner stably and accurately in the range of high adhesion amount on the black transfer belt, on which the sensitivity adjustments are not feasible for the diffusion reflection output, without affected by (a) the scattering in sensor characteristics from one production lot to another, (b) the variation in sensor characteristics with the elapse of time and the change in environmental conditions, and (c) an overtime change of the transfer belt conditions.

Accordingly, an object of the present disclosure is to solve the above problems in the conventional technique such as (1) making it unnecessary to strictly adjust the relative magnitude between the "regular reflection output" and the "diffuse reflection output" on the of sensors (hardware part), whereby contributing to the reduction of production costs by increasing flexibility at the stage of outgoing inspection, and (2) making the automatic correction feasible by improved features on the software part regardless of the abovementioned three factors, to thereby realize a suitable method of converting the adhesion amount of toner materials on the black transfer belt in the range of high adhesion amount and an image-forming apparatus capable of implementing the conversion method.

The object of the present invention can be achieved by providing the adhesion amount conversion algorithm and an image-forming apparatus and its peripherals capable of implementing the algorithm.

Specifically, the object of the invention is achieved by an algorithm which is configured to achieve the conversion of the diffuse reflection output into a value uniquely determined with respect to the adhesion amount. This algorithm is configured to perform several process steps including (1) gradation patterns are read with the aforementioned reflection type optical sensor of the type (C) or (D), capable of providing two outputs of "regular reflection output" and "diffuse reflection output"; (2) the two outputs are converted into a value having a linear relation with respect to the adhesion amount in the range of the amount in which the detection of the adhesion amount by the regular reflection light is feasible; and (3) sensitivity correction of a converted value of the diffuse reflection output is performed based on the converted value of the regular reflection output, in which a unique relationship is established between the adhesion amount and the converted value of the regular reflection output, whereby the conversion is achieved for the diffuse reflection output as well into the value uniquely determined with respect to the adhesion amount.

The adhesion amount conversion algorithm will be detailed herein below.

In the first place, a four-chambered tandem type direct transfer full-color laser printer is described in reference to FIG. 1 as an image-forming apparatus and also an apparatus of detecting the adhesion amount of powder materials in the invention.

The full-color laser printer is provided with three copy sheet trays, i.e., one manual feed tray 36 and two sheet feed cassettes 34,34 (as first and second trays). A transfer paper sheet (not shown) as recording medium fed from the manual feed tray 36 is sequentially separated one by one from top by a feeding roller 37, and fed forward to a registration roller pair 23. The transfer paper sheet loaded on either the first or second sheet feed cassettes 34,34 is sequentially separated one by one from top by a feed roller 235, and fed forward to the registration roller pair 23 by way of a carrier roller pair 39.

The thus fed transfer sheet is temporarily brought to a stop at the registration roller pair 23, a skew of the sheet is corrected, and fed toward a transfer belt 18 by the rotation of the roller pair 23 according to on-control with a registration clutch (not shown), at such a timing that the edge of the image, formed on a photosensitive drum 14Y located at the uppermost stream, coincides with a predetermined position of the transfer paper in the transport direction.

Subsequently, the transfer paper is electrostatically attracted to the transfer belt 18 owning to a bias voltage applied to a paper attraction roller 41 on passing through a paper attraction nip, which is formed of the transfer belt 18 and the paper attraction roller 41 abutting against the transfer belt 18, and carried forward at a process linear velocity of 125 mm/sec.

Photosensitive drums 14B, 14C, 14M, and 14Y for forming the respective colors in the color printer are provided with transfer brushes 21B, 21C, 21M, and 21Y which are respectively arranged at the positions opposing to the photosensitive drums 14B, 14C, 14M, and 14Y.

By positively biasing the transfer paper attracted on the transfer belt 18, which is in the polarity opposite to that of the transfer brushes 21B, 21C, 21M, and 21Y (i.e., negative), toner images in respective colors formed on the photosensitive drums 14B, 14C, 14M, and 14Y are transferred in order of Y (yellow), M (magenta), C (cyan), and B (black).

Following the transfer process step of the toner images in respective colors, the transfer paper sheet is subjected to self stripping with curvature from the transfer belt 18 at a drive roller 18 downstream of the sheet path, and forwarded to a fixing unit 24.

The transfer paper sheet passes through a fixing nip, which is formed of a fixing belt 25 and a pressing roller 26, whereby the toner images are permanently fixed onto the transfer paper sheet by appropriately heating under pressure. The thus fixed transfer sheet is ejected onto an FD (or face down) tray 30 provided on the upper face of the main chassis of the printer in the case of single-side printing.

In the case when the duplex printing mode is selected beforehand, the transfer paper exiting from the fixing apparatus 224 is forwarded to an inverting unit (not shown), and to a duplex carrier unit 33 located below the transport unit to be the both sides inverted by the inverting unit. The transfer paper is re-fed from the duplex carrier unit 33, and conveyed to the registration roller pair 23 by way of the carrier roller pair 39. Subsequently, the paper sheet goes through the same path as that of the single-side printing mode, then through the fixing unit 24, and ejected onto the FD tray 30.

The configuration of, and the imaging operation performed in image forming sections of the color laser printer will be explained in detail.

Since the image forming sections for respective colors are similar in configuration and imaging operation, the following detailed description will be made primarily on the yellow image, and the explanation on other colors is abbreviated herein.

In the vicinity of the photosensitive drum 14Y located uppermost stream in the conveyance direction of the transfer paper sheet, there provided are a charging roller 42Y, an imaging unit 12Y including a cleaning unit 43Y, a development unit 13Y, and an optical detecting unit 16.

During the image formation, the photosensitive drum 14Y is configured to rotate in the clockwise direction in the drawing by a main motor (not shown), and eliminate electrostatic charges by applying AC bias (with zero DC component) to the charging roller 42Y, so that the surface potential of the drum 14Y is brought to a reference potential of about −50 volts.

Subsequently, the photosensitive drum 14Y is uniformly charged to a potential substantially equal to a DC component by applying a DC bias superposed with an AC bias so that the surface potential thereof is charged ranging approximately from −500 to −700 volts (in which the target potential may be determined depending on the design of a process control unit).

Digital image information sent from a control unit (not shown) as an image to be printed is converted to a binarized signal of LD light emission for respective colors, and an exposure light beam 16Y is irradiated onto the photosensitive drum 14Y with a optical write unit 16 including a cylindrical lens, a polygon motor, an f-theta lens, first through third mirrors, and a long toroidal (WTL) lens.

The potential of the drum surface at the irradiated location is decreased to approximately −50 volts and an electrostatic latent image is formed corresponding to the image information.

The electrostatic latent image on the photosensitive drum 14Y corresponding to the yellow image information is visualized with the development unit 13Y.

By applying a DC potential superposed with an AC bias (−300 to −500 volts) to a developing sleeve 44Y in the development unit 13Y, an image development with toner (Q/M: −20 to −30 μC/g) is carried out only at the imaging location where the potential is decreased by the image write step, whereby a toner image is formed.

The toner images formed on the photosensitive drums for respective colors, 14B, 14C, 14M, and 14Y, are transferred by the transfer bias onto the transfer paper sheet attached on the transfer belt 18.

In the color laser printer of the present embodiment, a process control operation (which is hereinafter refereed to as "pro-con operation") is performed in order to optimize the image density of the respective colors, at the time of machine power on or after a predetermined number of sheets fed, in addition to the abovementioned image forming steps.

In the pro-con operation, a plurality of density detection patches as gradation patterns (hereinafter, as "P patterns") are formed for respective colors on the transfer belt by successively switching between charging bias and development bias at a predetermined timing, and the voltage outputted from these P patterns is detected with a density detection sensor (hereinafter, as P sensor) 40 which arranged outside the transfer belt 18 close to the drive roller 19.

The output voltage is subjected to the adhesion amount conversion according to the adhesion amount conversion algorithm (method for converting the adhesion amount of particulate materials) of the present invention, to obtain a value representing the present developing ability (development Y, Vk). Based on thus calculated value, control for changing the development bias and the target value for toner density control is performed.

The configuration of the P sensor is as illustrated in FIG. 4, and the specification data thereof were described earlier.

Although the phototransistor (PTr) is used for the photodetector, other photodetectors such as a photodiode (PD) may alternatively be used.

The adhesion amount conversion algorithm in the invention will be described herein below based on the experimental results illustrated in FIGS. 10 through 13.

In this algorithm, the diffuse reflection output is converted into an adhesion amount according to the following steps;

(1) sampling a regular reflection output and a diffuse reflection output from the gradation patterns (see FIGS. 11 and 13);

(2) extracting only the "regular reflection components" by separating, through component decomposition, the "regular reflection components" and "diffuse reflection components" from the regular reflection output;

(3) extracting "diffuse reflection components from the toner" by removing "diffuse reflection components from the belt background" from the diffuse reflection output;

(4) uniquely determining the diffuse reflection output (corrected value) with respect to the adhesion amount by utilizing the linear relationship established between the two output conversion values obtained by the abovementioned steps (2) and (3), which are mutually independent (orthogonal) with each other, and by performing sensitivity correction on diffuse reflection output conversion value such that the diffuse reflection output conversion value extracted from the regular reflection output conversion value (or adhesion amount) is brought to be equal to a predetermined value in the range of the adhesion amount, in which the detection of the adhesion amount by the regular reflection light is feasible (the range of low adhesion amount); and (5) performing the adhesion amount conversion processing based on the relation between an "adhesion amount" obtained beforehand and the "corrected diffuse reflection output value".

These process steps (1) through (5) included in the algorithm will be detailed herein below.

Figure 18:
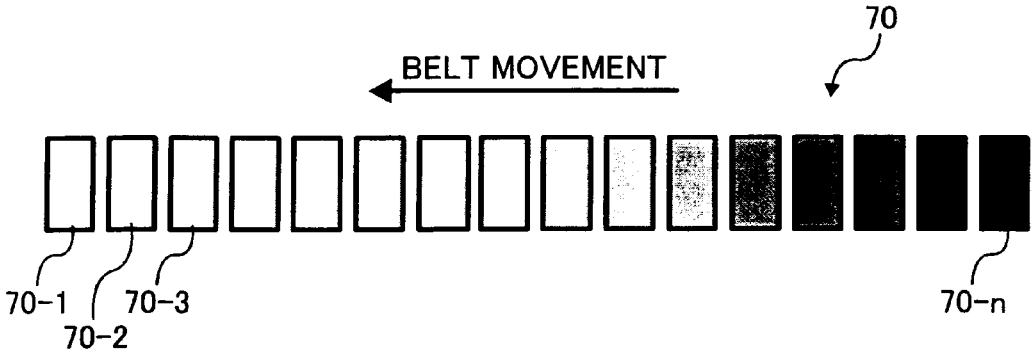
FIG. 18 illustrates gradation patterns for density detection formed on the transfer belt such that the amount of toner adhesion increases toward upstream in the belt traveling direction.

In regard to the process step (1) in the algorithm, an amount of color toner adhesion (mg/cm$^2$) was obtained with an electronic balance by minutely weighing each of P patterns 70 of FIG. 18, which was formed for density detection on the transfer belt 18. The gradation patterns 70 were formed such that the amount of toner adhesion increased toward upstream in the belt traveling direction.

FIGS. 11 and 13 plot respectively the values of "regular reflection output voltage" and "diffuse reflection output voltage" detected with P sensor 40 of FIG. 4, vertically, versus the amounts of color toner adhesion (adhesion amount) measured as above, horizontally.

For the transfer belt 18, three types were used each having different specular gloss level and lightness.

In regard to the process step (2) in the algorithm, the regular reflection output characteristic with respect to the black toner adhesion illustrated in FIG. 10 was compared with the regular reflection output characteristic with respect to the amount color toner adhesion illustrated in FIG. 11. It is indicated in FIG. 11 that the regular reflection output changes from a monotonous decrease to an increase at a certain adhesion amount (0.2 to 0.4 mg/cm$^2$, in this case).

Figure 19B:
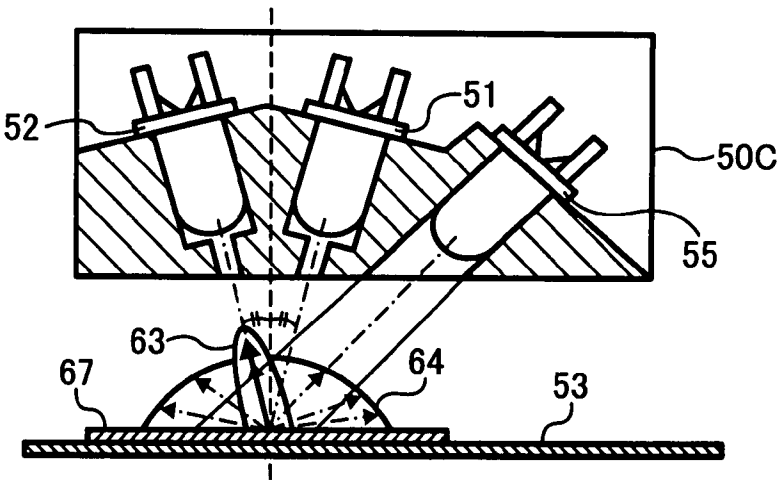
FIGS. 19A and 19B illustrate light beams detected by the optical detecting unit, in which the light detected by the regular reflection photodetector, as the regular reflection light, includes diffuse reflection components from the belt surface and diffuse reflection components from the toner layer in addition to the pure regular reflection components.
Figure 19A:
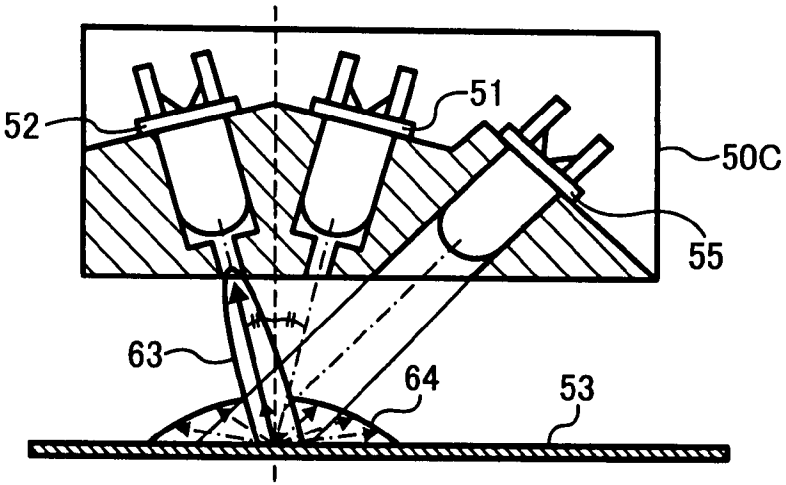
Figure 20:
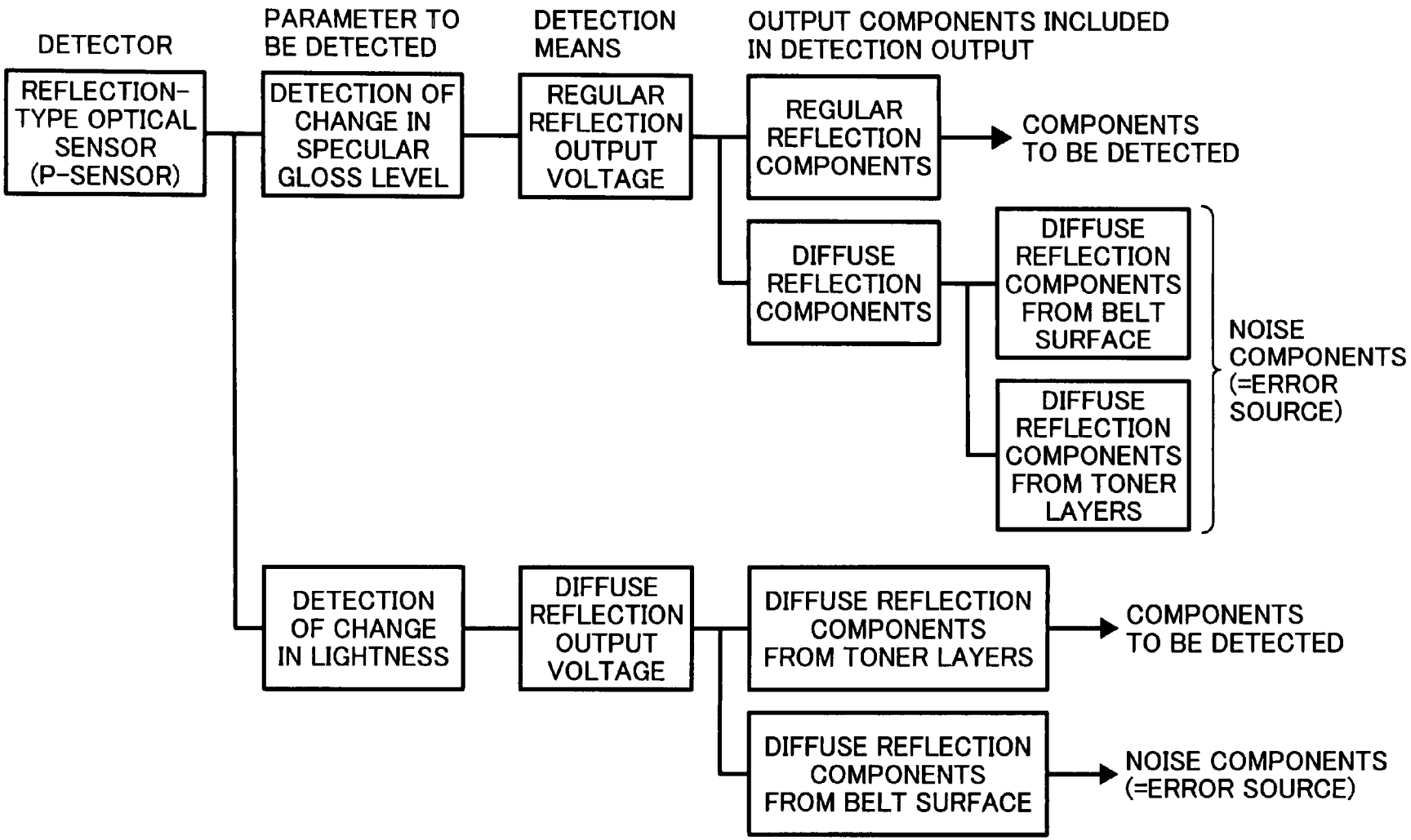
FIG. 20 illustrates the results of analysis on the light detected by the regular reflection photodetector indicating several components including regular reflection components, diffuse reflection components from the belt surface, diffuse reflection components from the toner layer, and the diffuse reflection light from the belt background (noise component)

The reasons for the change is considered that the light detected by the regular reflection photodetector 52 as the regular reflection light includes "diffuse reflection components from the belt surface" and "diffuse reflection components from the toner layer", in addition to the pure "regular reflection components", as illustrated in FIGS. 19A, 19B, and 20. The reference numeral 67 denotes a solid image portion of cyan.

Considering that the light emitted from the LED 51 is uniformly diffused on the target surface for detection, as illustrated in FIGS. 19A and 19B, an n-times relationship can be assumed between the diffuse reflection components received by the regular reflection photodetector 52 and the diffuse reflection light entering into the diffuse reflection photodetector 55.

The value "n" included herein is dependent on the optical layout such as the aperture and overall arrangement of photodetectors 52 and 55.

In addition, the output is obtained in fact as a voltage following the incidence of the reflected light into the respective photodetectors 52 and 55, and the subsequent I-V conversion by an OP amplifier in the circuit.

As a result, the difference in OP gain in each output has to be multiplied to the respective outputs, whereby the relationship is now denoted by $\alpha$-times relation.

Therefore, if the coefficient "$\alpha$" is obtained, the components of the regular reflection output can be divided into the "regular reflection components" and the "diffuse reflection components".

It is now considered how to obtain the coefficient "a" with respect to the black (Bk) toner.

Since the diffuse reflection components for black toner appear to be as small as approximately zero, it can be considered that the regular reflection output characteristic of Bk illustrated in FIG. 10 is substantially equal to the regular reflection output characteristic of the color toner, from which the diffuse reflection components are removed.

As illustrated in FIG. 10, the regular reflection output becomes close to zero and positive (not negative) with increasing the adhesion amount.

Therefore, by determining a minimum value of a ratio between the regular reflection output and the diffuse reflection output for each P pattern for the color toner, and by subtracting, from the regular reflection output, the value obtained by multiplying the diffuse reflection output by the minimum value of the ratio, the intended output characteristic of only the regular reflection components should be able to be extracted.

Such a process flow will be described herein below with respect to output characteristics for a brown belt (Gs=27, L*=25) illustrated in FIG. 11.

The following notations are used such as Vsg being output voltage from the background of transfer belt 18, Vsp output voltage from each pattern, Voffset offset voltage (i.e., output voltage at the time LED is off), _reg. the abbreviation of regular reflection output, _dif. the abbreviation of diffuse reflection output, and [n] number of elements, i.e., array variable of n.

Figure 21:
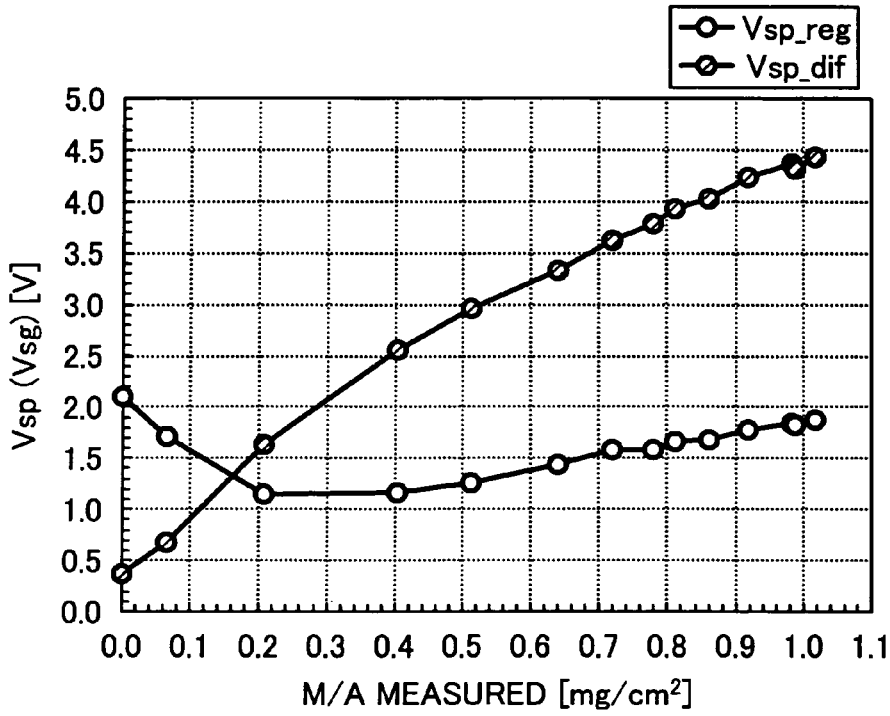
FIG. 21 plots the results of detected outputs, vertically versus the adhesion amount of toner obtained by data sampling, horizontally.
Figure 22:
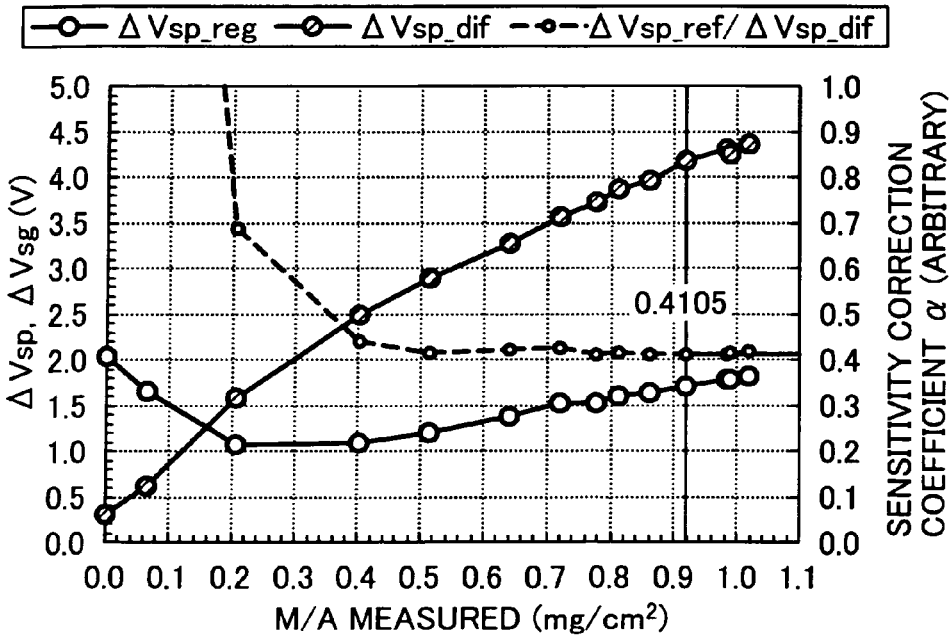
FIG. 22 illustrates the results of computation of the sensitivity correction coefficient, plotting the regular reflection output increment and diffuse reflection output increment, vertically, versus adhesion amount of toner obtained during data sampling.

(Step 1) Data Sampling: Computation of ΔVsp, ΔVsg (FIGS. 21 and 22)

First, a difference between the regular reflection output and the offset voltage, and a difference between the diffuse reflection output and the offset voltage are computed for all points [n] according to the expression (1).

These computation steps are performed in order to finally express the "increment of the sensor output with respect to the increment caused by the adhesion amount change for the color toner".

Regular reflection output increment:

$$\Delta Vsp_reg.[n]=Vsp_reg.[n]-V\text{offset}_reg.$$

Diffuse reflection output increment:

$$\Delta Vsg_ref.[n]=Vsp_dif.[n]-V\text{offset}_dif \quad (1).$$

It may be noted that such difference computation step can be eliminated when an OP amplifier is used, which has such a device characteristic as that its respective offset output value from the LED 51 sufficiently small when turned off (for example, Voffset_reg. 0.0621 volt and Voffset_dif. 0.0635 volt, as in the embodiment).

(Step 2) Computation of Sensitivity Correction Coefficient "$\alpha$" (FIG. 22)

From ΔVsp_reg.[n] and ΔVsp_dif.[n] obtained in STEP 1, the ratio ΔVsp_reg.[n]/ΔVsp_dif.[n] is computed for each point. In addition, the computation of the coefficient "α" is carried out according to the expression (2) as the one to be multiplied to the diffuse reflection output (ΔVsp_dif.[n]) when the component decomposition of the regular reflection output is carried out in Step 3.

$$\alpha=\min\{\Delta Vsp_reg.[n]/\Delta Vsp_dif.[n]\} \quad (2).$$

The above-noted computation is performed based on the fact previously derived that minimum values of the regular reflection components out of the regular reflection output are approximately zero and positive.

It may be added that the gradation patterns are herein formed such that at least one, or preferably at least three, pattern(s) are included in the region in vicinity of the adhesion amount which corresponds to the minimum value of the ratio between the regular reflection output and the diffuse reflection output.

Alternatively, the gradation patterns may be formed such that at least one, or preferably at least three, pattern(s) are included in the region in vicinity of the adhesion amount which corresponds to the minimum value of the ratio between the regular reflection output increment and diffuse reflection output increment, each obtained from the difference of the output values between the conditions of light source on or off, respectively.

Still alternatively, at least one, or preferably at least three, pattern(s) may be included within the range of adhesion amount, where the regular reflection output conversion values have a linear relationship with respect to the adhesion amount.

Figure 23:
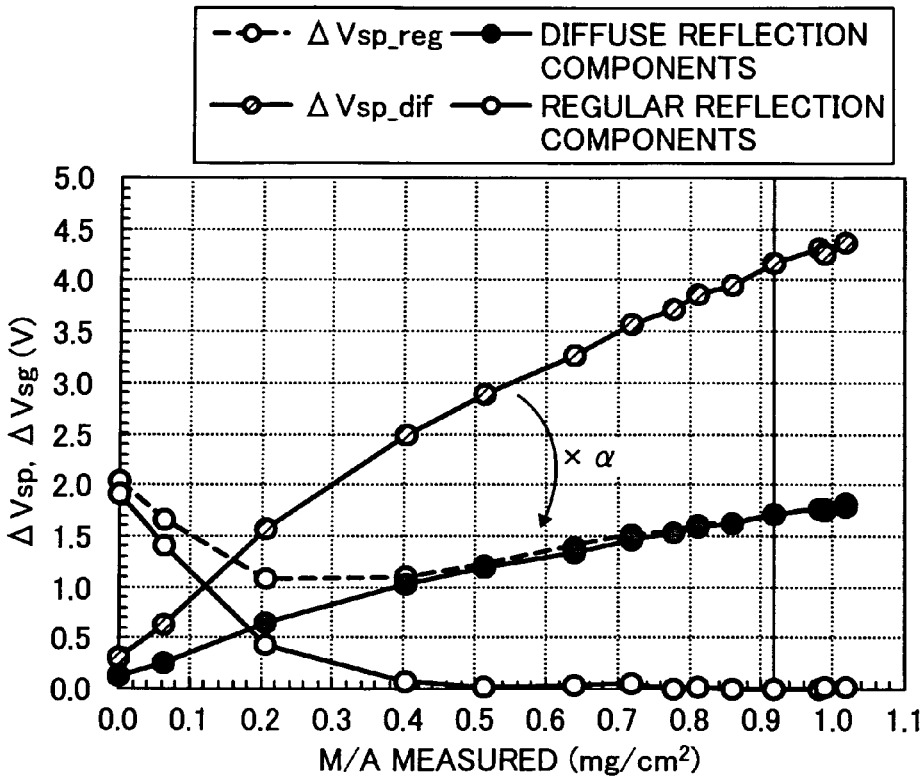
FIG. 23 illustrates the results of component decomposition of the regular reflection output, plotting the regular reflection output increment and diffuse reflection output increment, vertically, versus adhesion amount of toner obtained during data sampling, which facilitates the proper conversion achieved by obtaining experimentally the relations between the adhesion amount and the normalization as a numerical expression or reference table in advance.

(Step 3) Component Decomposition of Regular Reflection Output (FIG. 23)

The component decomposition of the regular reflection output is performed according to the expression (3).

Diffuse reflection components in regular reflection output:

$$\Delta Vsp_reg._dif.[n]=Vsp_dif.[n]\times\alpha$$

Regular reflection components in regular reflection output:

$$\Delta Vsp_reg._reg.[n]=Vsp_reg.[n]\cdot\Delta Vsp_reg._dif.[n] \quad (3).$$

By thus performing the component decomposition the regular reflection output components in the regular reflection output become zero in the pattern portion where the sensitivity correction coefficient "α" is computed.

Through this processing, as illustrated in FIG. 23, the regular reflection output is divided into the "regular reflection components" and the "diffuse reflection components".

Figure 24:
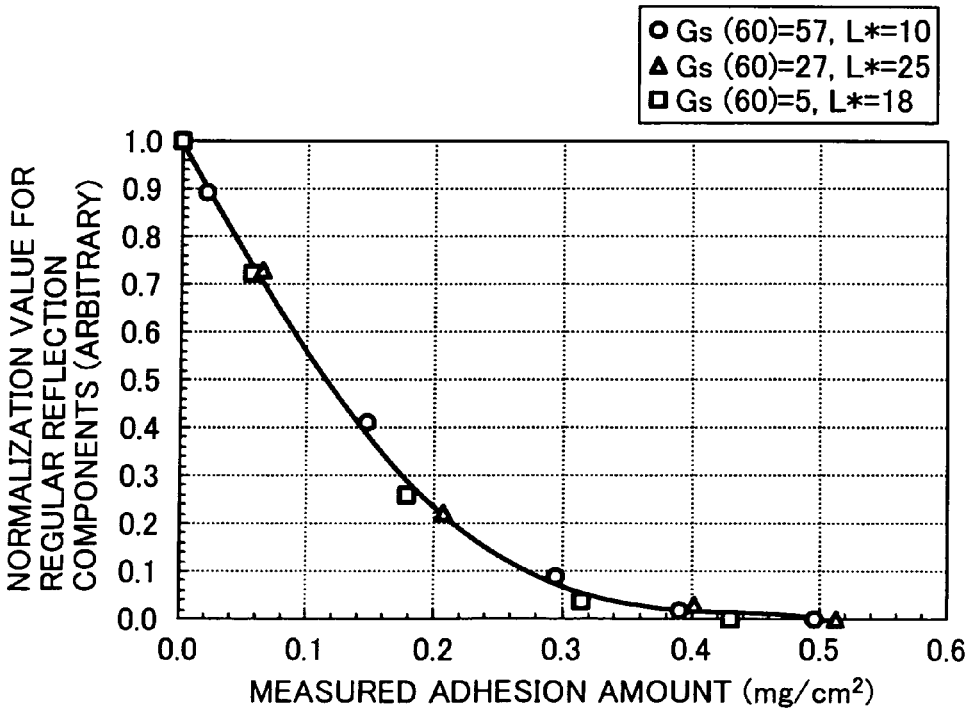
FIG. 24 illustrates the results of conversion to the normalization values obtained by performing similar processing on the three types of belts of FIG. 11.

(Step 4) Normalization of Regular Reflection Components in Regular Reflection Output (FIG. 24)

In order to correct the difference in the regular reflection outputs from the background of the three types of the belts, a ratio in the output from each pattern versus the belt background is computed and converted to a normalization value ranging from 0 to 1.

Normalization value:

$$\beta[n] = \Delta Vsp_reg._reg._ / \Delta Vsg_reg._reg. \quad (4)$$

( = Exposure rate of transfer belt background).

FIG. 24 illustrates the results of conversion to the normalization values obtained by performing similar processing on the three types of belts of FIG. 11.

By dividing the components in the regular reflection light, extracting only the regular reflection components, and converting the components into the normalization value, as described above, the relation between the regular reflection components and the adhesion amount can uniquely be determined.

In addition, this value indicates the exposure rate of the background of the belt, and in the range of adhesion amount from zero to one layer formation, this normalization value (i.e., exposure rate of the belt background) is in the linear relationship with respect to the adhesion amount.

In the case when it is intended to determine the adhesion amount of toner in the low adhesion range of M/A=0 to 0.4 mg/cm$^2$, the proper conversion can be achieved by obtaining experimentally the relations between the adhesion amount and the normalization as a numerical expression or reference table as illustrated in FIG. 23 in advance, and subsequently by either performing the inverse transformation or referring to the table, respectively.

In this context, a comparison will be made with the conventional technique. It is stated in Claim 4 in Japanese Laid-Open Patent Application No. 2001-215850, in that an expression of "regular reflection light+(diffuse reflection light−irregular reflection output min)×(a predetermined coefficient) is disclosed, and that, in an embodiment in the specification, there found a description that the predetermined coefficient is set to be −6 so that the output after correction has a linear relationship. However, the multiplication of the predetermined coefficient in this manner is not considered reasonable since scattering in characteristics is not taken into consideration with respect to optical devices.

In the method of the present invention, by contrast, the coefficient, which is computed based on the sensor outputs of the regular reflection light and diffuse reflection light, is multiplied as the predetermined coefficient. As a result, highly accurate detection of toner adhesion can be performed, taking into consideration a characteristic difference of the optical detecting unit.

In regard to the process step (3) in the algorithm, the process of removing the "diffuse reflection output components from the belt background" from the "diffuse reflection output voltage" will be explained below.

What intended to finally obtain in this embodiment by means of the adhesion amount conversion algorithm has a unique relationship between the diffuse reflection output and the adhesion amount of toner.

However, the light incident onto the diffuse reflection photodetector 55 includes the diffuse reflection light from the belt background (noise component) in addition to the diffuse reflection light from the toner layer, as illustrated in FIG. 20. Therefore, it is necessary to remove this noise component from the original output.

Referring to FIG. 20, the ratio between the "background output" and "pattern portion output" in the regular reflection components is uniquely determined with respect to the adhesion amount (in the range of detectable adhesion amount: 0 to 0.4 mg/cm$^2$).

In addition, under the conditions of the light intensity onto the target surface being constant the relation between the diffuse reflection components from the toner layer and the adhesion amount is uniquely determined (in the range of detectable adhesion amount: 0 to 1.0 mg/cm$^2$).

As a follow-up of the process step 4, the processing flow will be explained based on the output result of the brown belt (Gs=27, L*=25) illustrated in FIG. 13.

The diffuse reflection output from the belt background becomes the largest in the belt background where the toner does not adhere and the components gradually decrease as the toner adheres, as shown in FIG. 13.

The relation between the diffuse reflection output voltage increment caused by the light incident directly onto the diffuse reflection photodetector 55 from the belt background and the adhesion amount is proportional to the exposure rate of the transfer belt 18, i.e., the normalization value of the regular reflection components in the regular reflection output obtained previously (FIG. 24). Therefore, the process for removing the "diffuse reflection output components from the belt background" from the "diffuse reflection output voltage" is obtained as described herein below.

Figure 25:
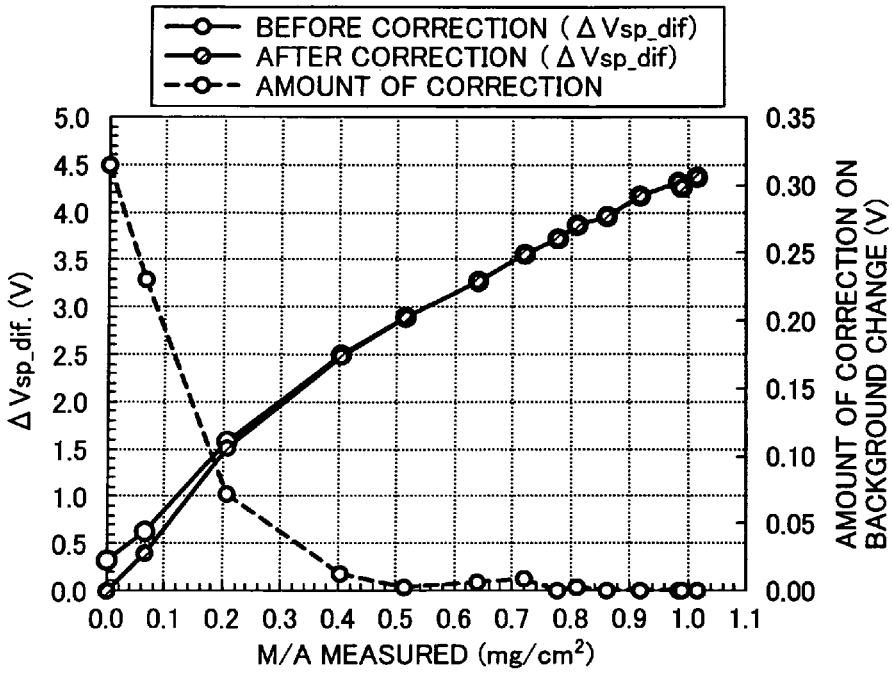
FIG. 25 illustrates the results of correction of changes in the background in the diffuse reflection output, plotting the diffuse reflection output increment before and after the correction, vertically, versus adhesion amount measured.

(Step 5) Correction of Changes in the Background in the Diffuse Reflection Output (FIG. 25)

Diffuse reflection output after correction:

$$\begin{aligned}\Delta Vsp_dif' &= [\text{diffuse reflection output voltage}] - \\ &\quad [\text{belt background output}] \times \\ &\quad [\text{normalization value of regular reflection components}] \\ &= \Delta Vsp_dif(n) \cdot \Delta Vsp_dif. \times \beta(n)\end{aligned} \tag{5}$$

Figure 26:
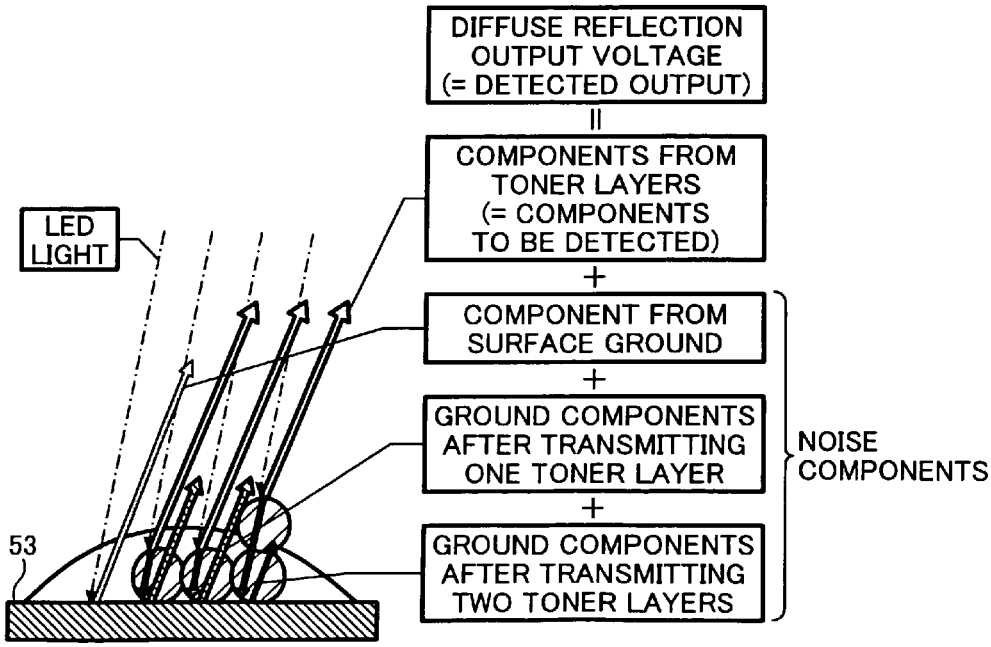
FIG. 26 illustrates the results of analysis indicating that the light reflected from the belt background includes primary components directly reflected from the belt background, and secondary and tertiary components reflected after having transmitted through the toner layer.

The results obtained from the computation are illustrated in FIG. 26.

By performing such correction processing, the influence of the background of the transfer belt 18 can be eliminated. Therefore, the "diffuse reflection components directly reflected from the belt background" can be removed from the "diffuse reflection output" in the low adhesion amount range in which the regular reflection output has a higher sensitivity.

In addition, the diffuse reflection output after correction in the adhesion amount range from zero to one layer formation can be converted to the values graphically crossing the origin having a linear relation with respect to the adhesion amount.

The diffuse reflection light will be explained further.

The regular reflection light is the light reflected from the surface of the target surface to be detected. When the target surface is completely covered with the toner (100% coverage), therefore, the light output does not change further beyond the point corresponding to the 100% coverage and the normalization conversion value becomes approximately zero, as illustrated in FIG. 24.

By contrast, the diffuse reflection light is the one that entered once into the toner layer and subsequently multi-reflected. Therefore, as illustrated in FIG. 13, the sensor output exhibits the characteristic of monotonous increase with increasing the adhesion amount even in the high adhesion range exceeding the 100% toner coverage.

Namely, as illustrated in FIG. 26, the light reflected from the belt background includes primary components directly reflected from the belt background, and secondary and tertiary components reflected after having transmitted through the toner layer.

Although the correction in this embodiment is performed only on the primary components at Step 5, the influence of the belt background can practically be removed accurately only with this correction at least in the low adhesion range where the sensitivity correction is considered important from the consideration of the layer number and thickness.

That is, since the secondary and tertiary components are considered sufficiently small as compared with the primary components, practically sufficient accuracy can be achieved through the correction dealing with only the primary components.

In regard to the process step (4) in the algorithm, by the abovementioned processing performed in the low adhesion amount range in which the regular reflection output has a higher sensitivity, only the "regular reflection components" that can uniquely express the relation with the adhesion amount of toner can be extracted from the regular reflection light in the aforementioned process step (2) in the algorithm, and the "diffuse reflection components directly reflected from the belt background" can be removed from the diffuse reflection light in the process step (3) in the algorithm. Based on the result of these steps, the sensitivity correction on the diffuse reflection output can now be carried out.

As indicated earlier, the sensitivity correction on the diffuse reflection output includes (1) the correction the difference in output characteristics of light emitting diode output and the photodetector from one production lot to another (scattering in sensor characteristics), and (2) the correction on the temperature characteristics and the change over time for the devices (variation in sensor characteristics).

The most important basis for this processing is the linear relationship of both the converted regular, and the diffusion reflection light outputs with respect to the adhesion amount of toner, which is confirmed as above in the low adhesion amount range where at most one single toner layer is formed, and which includes (a) the normalization value of the regular reflection output (regular reflection components), i.e., the exposure rate of the transfer belt background is linearly proportional to the adhesion amount of toner; and (b) the "diffuse reflection components from the toner layer" are converted into the values graphically crossing the origin and having a linear relation with respect to the adhesion amount.

Several methods may be considered for correcting the sensitivity. A couple of methods will be illustrated herein below.

(Step 6) Sensitivity Correction on Diffuse Reflection Output (FIG. 25)

<Processing Equation According to First Method>

Figure 27:
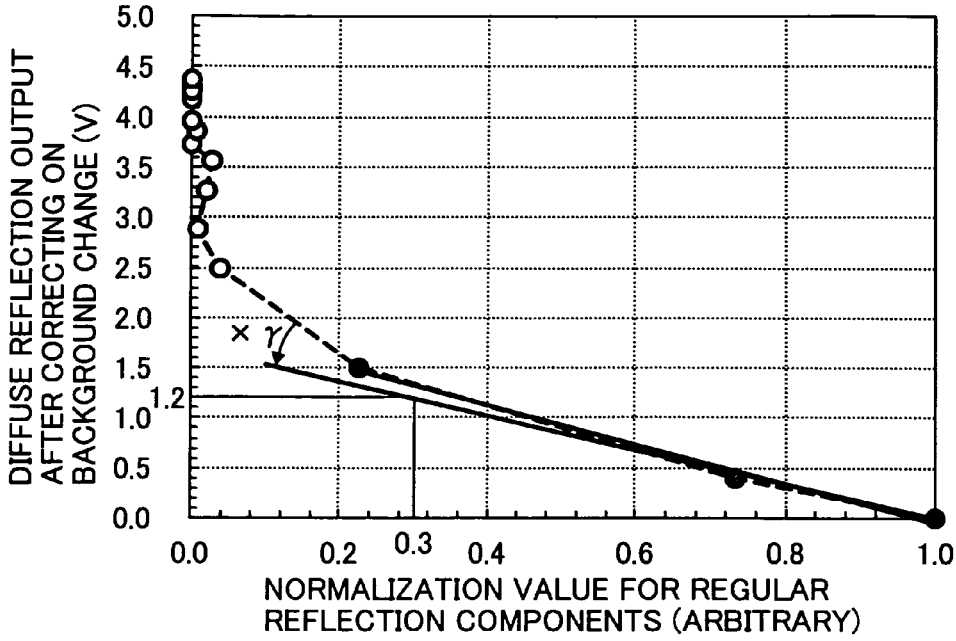
FIG. 27 plots the value of the diffuse reflection output after correcting on the change in the background with respect to the normalization value of the regular reflection light (regular reflection components), in which the sensitivity of the diffuse reflection output is obtained from the linear relationship in the low adhesion range and the correction on the sensitivity is carried out to reach a predetermined sensitivity.

The value of the "diffuse reflection output after correcting on the change in the background" is plotted with respect to the "normalization value of the regular reflection light (regular reflection components)", as illustrated in FIG. 27. Subsequently, the sensitivity of the diffuse reflection output is obtained from the linear relationship in the low adhesion range and the correction on the sensitivity is carried out to reach a predetermined sensitivity.

It should be noted that the sensitivity of the diffuse reflection output herein stands for the gradient of the straight line shown in FIG. 27, and that a correction factor to be multiplied to the gradient is calculated so that the diffuse reflection output after correcting on the change in the background becomes a certain value (the output value 1.2 for the normalization value 0.3, in this embodiment).

(1) The gradient is computed by least squares method;

$$\text{Gradient of straight line} = \frac{\sum (x[i] - \overline{X})(y[i] - \overline{Y})}{\sum (x[i] - \overline{X})^2} \tag{6}$$

$$\text{Intercept on the } y\text{-axis} = \overline{Y} - \text{gradient} \times \overline{X},$$

where x[i] is normalization value for regular reflection components in regular reflection, $\overline{X}$ mean value of the normalization value for regular reflection components in regular reflection, y[i] diffuse reflection output after correction of background change, and $\overline{Y}$ mean value of diffuse reflection output after correction of background change, wherein the range of the variable x available for the computation is $0.06 \leqq x \leqq 1.0$.

Although the lower limit of the x range used for the calculation is set to 0.06 in the present embodiment, this value may alternatively be determined arbitrarily as long as the linear relationship between x and y is retained. In addition, the upper limit is herein set to 1, since the normalization value ranges from 0 to 1.

(2) Based on the thus obtained sensitivity value, a sensitivity correction factor Y is determined such that a certain normalization value "a" calculated from the sensitivity becomes another certain value "b".

$$\text{Sensitivity correction factor } Y = b/(\text{gradient} \times a + y \text{ intercept}) \quad (7).$$

(3) The correction is performed on the "diffuse reflection output after correcting on the change in the background" obtained previously in Step 5 by multiplying the sensitivity correction factor Y.

The point of reference for performing the sensitivity correction (i.e., a certain regular reflection output conversion value with which a correction factor is multiplied so that the diffuse reflection output conversion value with respect to a certain regular reflection output conversion value becomes a certain value) is in the aforementioned range where the detection of adhesion amount is feasible.

Diffuse reflection output after the sensitivity correction:

$$\begin{aligned}\Delta Vsp_dif'' &= \text{"diffuse reflection output after correction of background change"} \times \\ &\quad \text{"sensitivity correction factor } Y\text{"} \\ &= \Delta Vsp_dif(n)' \times Y.\end{aligned} \quad (8)$$

<Processing Equation according to Second Method>

Firstly, by converting the "normalization value of the regular reflection light (regular reflection components)" into adhesion amount (converted amount) by means of the inverse transformation equation or reference to the transformation, which is obtained from the relation between the adhesion amount (measured value) and the normalization value of the regular reflection light (regular reflection components) obtained from FIG. 24; secondly, plotting the converted amount with respect to the "diffuse reflection output after correction of background change"; and thirdly, determining the sensitivity of the diffuse reflection output from the linear relation in the low adhesion amount range, the correction on the diffuse reflection output is performed such that the sensitivity is brought to be equal to a predetermined sensitivity.

The difference in performing the correction between the first and second methods is that the horizontal axis is switched from the "normalization value of the regular reflection light (regular reflection components)" to the adhesion amount (converted amount).

Figure 28:
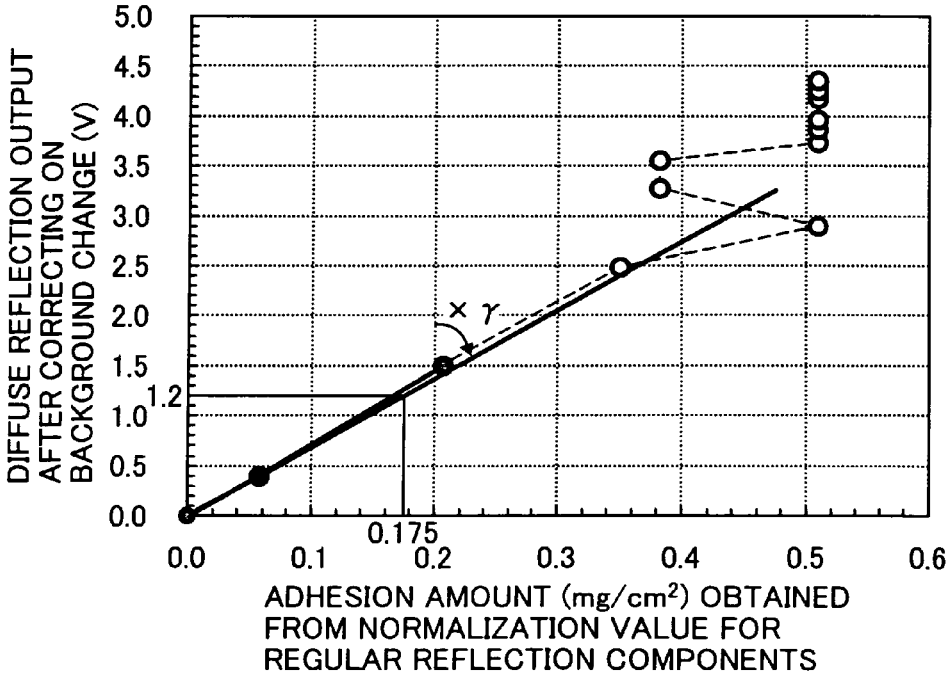
FIG. 28 plots the value of the diffuse reflection output after correcting on the change in the background with respect to the adhesion amount obtained by conversion from the normalization value of the regular reflection light (regular reflection components)

The sensitivity of the diffuse reflection output herein stands for the gradient of the straight line illustrated in FIG. 28. In addition, the correction factor to be multiplied to the present gradient is calculated such that the diffuse reflection output after correcting a background change is equated to a certain value (the output value 1.2 for the adhesion amount 0.175, in this embodiment).

(1) The gradient is computed by least squares method;

$$\text{Gradient of straight line} = \frac{\sum (x[i] - \overline{X})(y[i] - \overline{Y})}{\sum (x[i] - \overline{X})^2} \quad (9)$$

$$\text{Intercept on the } y\text{-axis} = \overline{Y} - \text{gradient} \times \overline{X},$$

where x[i] is an adhesion amount (converted amount), $\overline{X}$ mean value of the adhesion amount (converted amount), y[i] a diffuse reflection output after correction of background change, and $\overline{Y}$ mean value of the diffuse reflection output after correction of background change, wherein the range of the variable x available for the computation is $0 \leqq x \leqq 0.3$.

Although the upper limit of the x range used for the calculation is set to 0.3 in the present embodiment, this value may alternatively be determined arbitrarily as long as the linear relationship between x and y is retained. In addition, the lower limit is herein set to 0, since the lower limit of the adhesion amount is 0.

(2) Based on the sensitivity obtained, a sensitivity correction factor Y is determined such that a certain normalization value "a" calculated from the sensitivity becomes another certain value "b".

$$\text{Sensitivity correction factor } Y = b/(\text{gradient} \times a + y \text{ intercept}) \quad (10).$$

(3) The correction is performed on the "diffuse reflection output after correcting on the change in the background" obtained previously in Step 5 by multiplying the sensitivity correction factor Y.

$$\begin{aligned}\Delta Vsp_dif'' &= \text{"diffuse reflection output after correction of background change"} \times \\ &\quad \text{"sensitivity correction factor } Y\text{"} \\ &= \Delta Vsp_dif(n)' \times Y.\end{aligned} \quad (11)$$

The method of the present embodiment is characterized by the abovementioned step of obtaining the adhesion amount through the conversion based on the regular reflection components, which are computed by subtracting the diffuse reflection output multiplied by the minimum of the output ratio between the regular reflection and diffuse reflection from the regular reflection light from gradation patterns detected with a P sensor provided with one light emitting device and two photoreceptors (for receiving regular reflection and diffuse reflection, respectively).

Moreover, the present method is also characterized by linearly approximating the relation between the regular reflection components corrected by background regular reflection components and the diffuse reflection output in the low adhesion amount range, properly correcting the diffuse reflection output based on the abovementioned linear relationship between the regular reflection components and the diffuse reflection output, and obtaining the adhesion amount through the conversion based on the corrected diffuse reflection output.

In the methods of correcting the diffuse reflection output, the focus of the correction is placed so far primarily on the low adhesion range as described herein above. However, this may lead to a difficulty in achieving accurate adhesion amount conversion in the low adhesion range due to low detection capability caused by poor characteristics of the background surface.

In order to obviate this difficulty, a further method will be described herein below, in which the correction on the diffuse reflection output is carried out in the intermediate adhesion range to improve the accuracy of the correction on the diffuse reflection output.

<Processing Equation According to Third Method>

Figure 29:
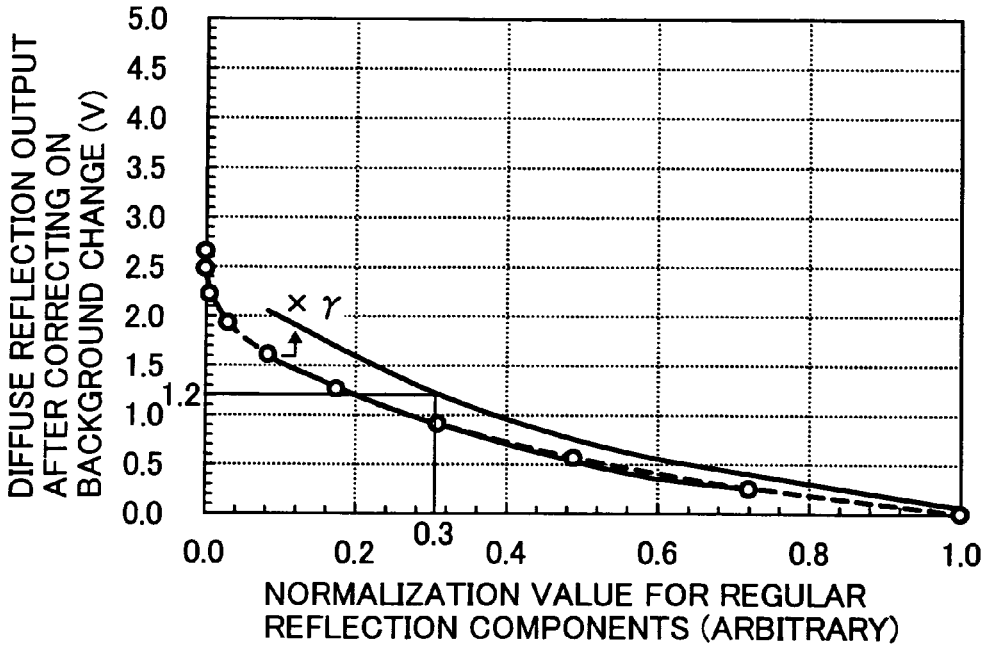
FIG. 29 plots the value of the diffuse reflection output after correcting on the change in the background with respect to the normalization value of the regular reflection light, in which the sensitivity of the diffuse reflection output is obtained from the relation in the intermediate adhesion range and the correction on the sensitivity is carried out to reach a predetermined sensitivity.

The value of the "diffuse reflection output after correcting on the change in the background" is plotted with respect to the "normalization value of the regular reflection light (regular reflection components)", as illustrated in FIG. 29.

The sensitivity of the diffuse reflection output is obtained from the relation in the intermediate adhesion range and the correction on the sensitivity is carried out to reach a predetermined sensitivity. That is, a correction factor is obtained such that the value of the diffuse reflection output after correcting on the change in the background is brought to be equal to a predetermined value and the correction is subsequently carried out with the correction factor.

(1) The gradient is computed by least squares method, in which a quadratic expression is used in this embodiment.

Assuming the quadratic expression is here assumed as $$y=\xi_1 x^2+\xi_2 x+\xi_3,$$

and the coefficients $\xi_1$, $\xi_2$, and $\xi_3$ are obtained by solving the simultaneous equation $$\xi_1\sum_{i=1}^{m}x[i]^2+\xi_2\sum_{i=1}^{m}x[i]^1+\xi_3\sum_{i=1}^{m}x[i]^0=\sum_{i=1}^{m}y[i]x[i]^0 \quad (12)$$

$$\xi_1\sum_{i=1}^{m}x[i]^3+\xi_2\sum_{i=1}^{m}x[i]^2+\xi_3\sum_{i=1}^{m}x[i]^1=\sum_{i=1}^{m}y[i]x[i]^1$$

$$\xi_1\sum_{i=1}^{m}x[i]^4+\xi_2\sum_{i=1}^{m}x[i]^3+\xi_3\sum_{i=1}^{m}x[i]^2=\sum_{i=1}^{m}y[i]x[i]^2,$$

where m is the number of data, x[i] is normalization value for regular reflection components in regular reflection, and y[i] is the diffuse reflection output after correction of background change, wherein the range of the variable x available for the computation is $0.05 \leqq x \leqq 070$.

Although the lower and upper limits of the x range used for the calculation are set to 0.05 and 0.70 in the present embodiment, respectively, these values may alternatively be determined arbitrarily. In addition, the upper limit is herein set to the value which is less susceptible to influences from the background surface.

(2) Based on the thus obtained sensitivity value, a sensitivity correction factor Y is determined such that a certain normalization value "a" calculated from the sensitivity becomes another certain value "b".

$$\text{Sensitivity correction factor } Y=b/(\xi_1\times a^2+\xi_2\times a+\xi_3) \quad (13).$$

(3) The correction is performed on the "diffuse reflection output after correcting on the change in the background" obtained previously in Step 5 by multiplying the sensitivity correction factor Y.

Diffuse reflection output after the sensitivity correction:

$$\begin{aligned}\Delta V\text{sp_dif}'' &= \text{"diffuse reflection output after correction of background change"}\times \\ &\quad \text{"sensitivity correction factor } Y\text{"} \\ &= \Delta V\text{sp_dif}(n)'\times Y.\end{aligned} \quad (14)$$

Figure 30:
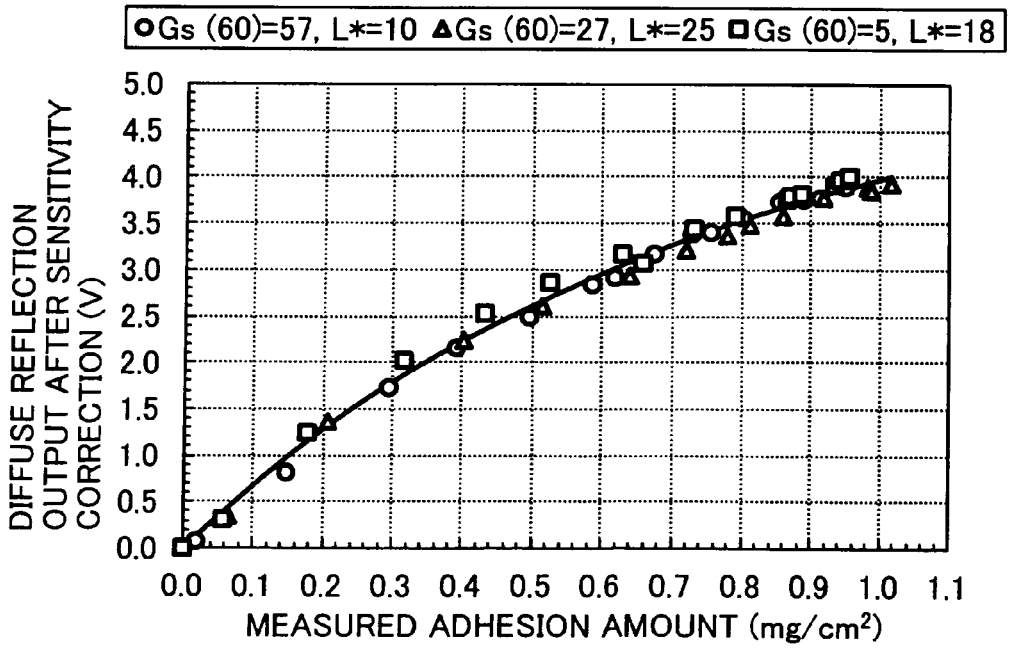
FIG. 30 illustrates results converted to the normalization value, obtained by performing the same processing on all three types of the belts.

FIG. 30 illustrates the conversion results to the normalization value, obtained by performing the same processing on all three types of the belts.

There found herein is that the present results are similar to those illustrated earlier in FIG. 13, thereby confirming that the abovementioned methods are effective, as the objectives of the invention, for properly correcting (1) the difference in output characteristics of light emitting diode output and the photodetector by the production lot (scattering in sensor characteristics), and (2) temperature characteristics and the change over time (variation in sensor characteristics).

As a result of such processing, the diffuse reflection output after correction of the sensitivity with respect to the adhesion amount of toner can be described uniquely. If the relationship is determined experimentally beforehand as a mathematical expression or in the form of reference table, accurate conversion of the adhesion amount becomes feasible up to the high adhesion range, by performing inverse transformation according to the expression or referring to the reference table.

Figure 31:
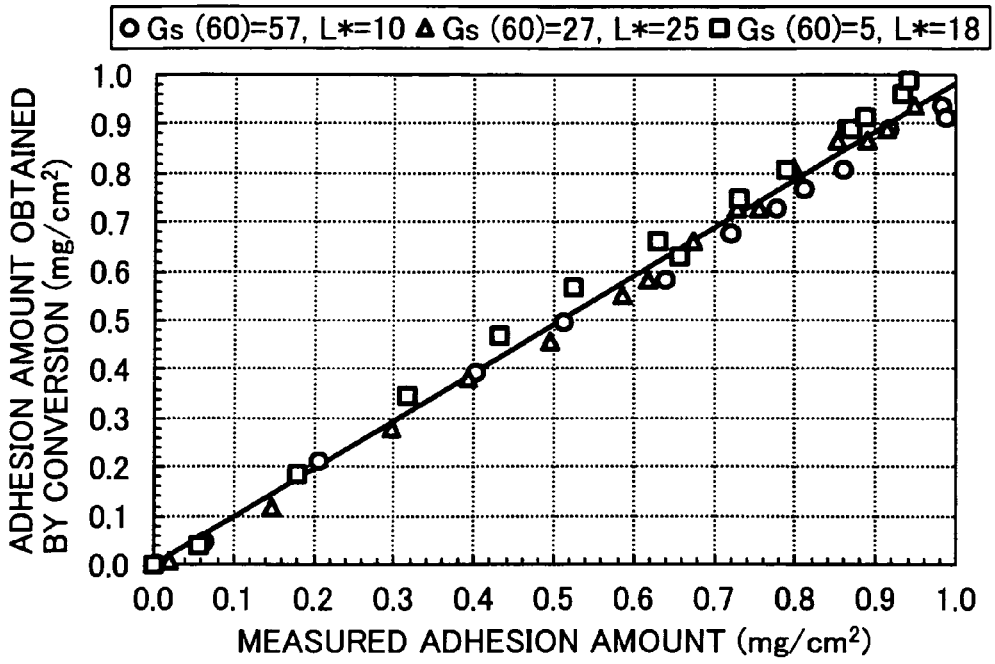
FIG. 31 plots the adhesion amount (converted value) obtained by converting the normalization value, vertically, with respect to the values of adhesion amount measure with an electronic balance, horizontally, which indicates a satisfactory correlation between the converted values and the measured amounts with the balance.

The results are illustrated in FIG. 31 by plotting the adhesion amount (converted value) actually obtained by converting the normalization value with respect to the values of adhesion amount measure with an electronic balance.

As shown in FIG. 31, a satisfactory correlation is found between the converted values and the measured amounts with the balance, and it is indicated that adhesion amount conversion can be achieved up to the high adhesion range.

Since accurate detection of the adhesion amount thus becomes feasible, the maximum target adhesion amount in the image density control can be accurately carried out. As a result, stable image quality is always obtained regardless of over-time difference, the changes in environmental conditions, and the scattering in sensor characteristics by the production lot.

Figure 32:
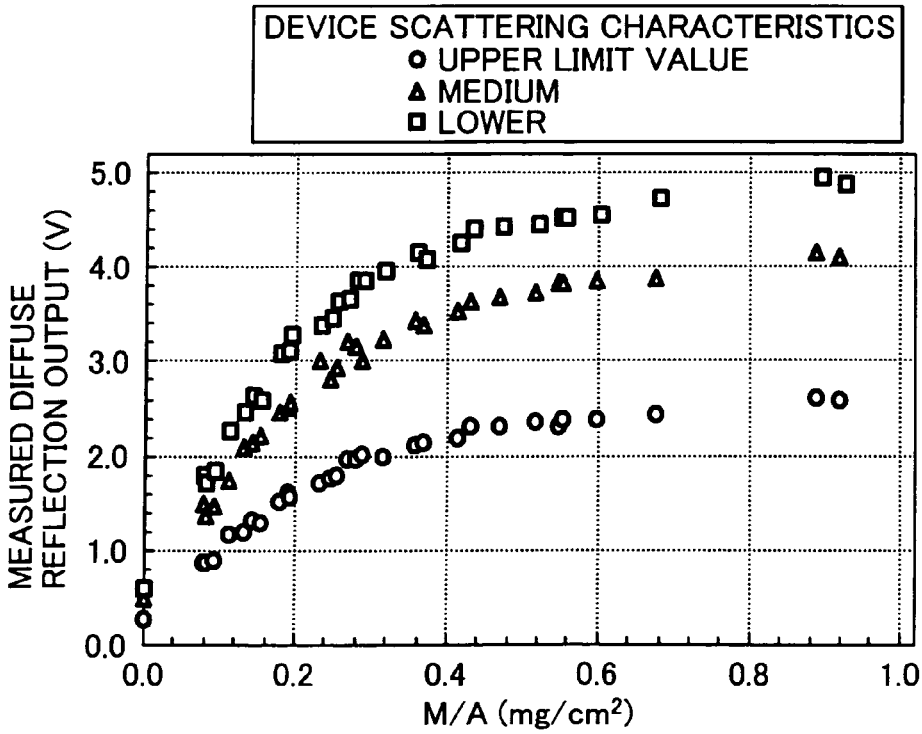
FIG. 32 plots the diffuse reflection output voltage, vertically, versus the adhesion amount, horizontally, in which the diffuse reflection output voltages are measured with respect to 30 gradation patterns, which consist of 10 patterns of each of three kinds of color toners, using three sensors which are selected from 200 specimen density detection sensors to have upper limit, medium, and lower limit values of device scattering characteristics, respectively.

FIG. 32 plots the diffuse reflection output voltage, vertically, versus the adhesion amount, horizontally. The diffuse reflection output voltages are measured with respect to 30 gradation patterns, which consist of 10 patterns of each of three kinds of color toners, using three sensors which are selected from 200 specimen density detection sensors to have upper limit, medium, and lower limit values of device scattering characteristics, respectively.

Figure 33:
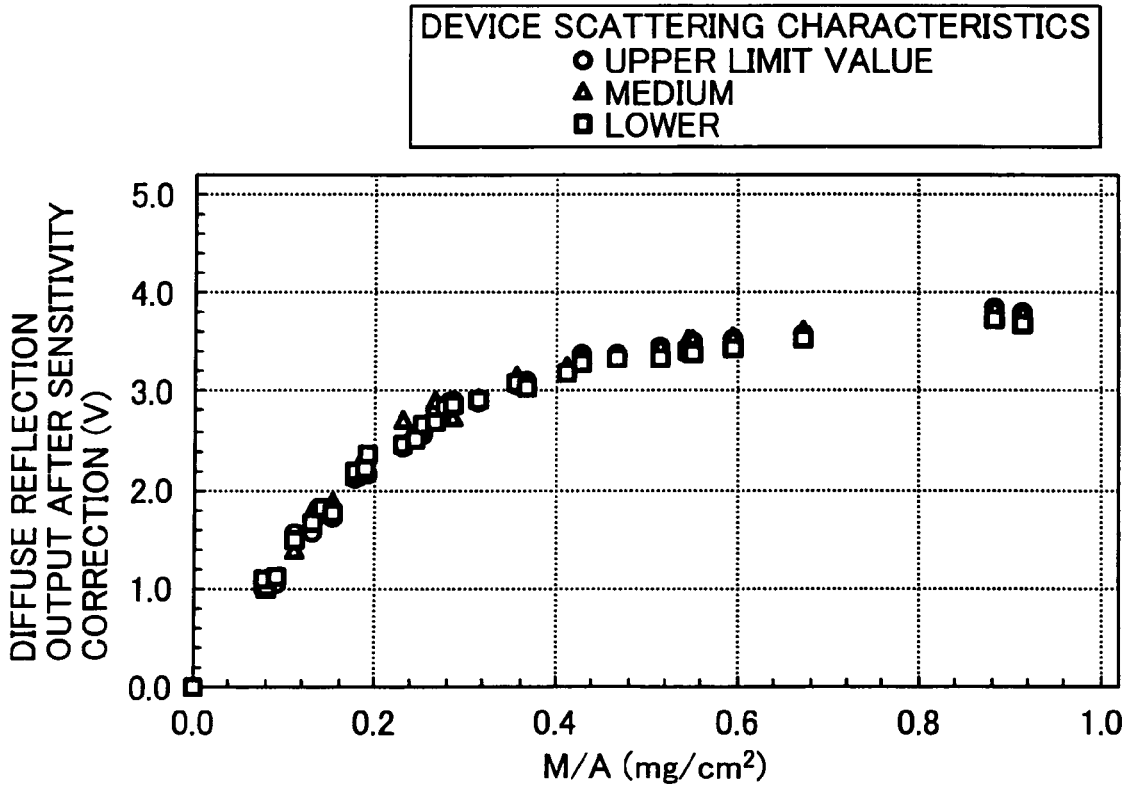
FIG. 33 illustrates diffuse reflection conversion values which are obtained by converting the output voltage values of FIG. 32 according to the abovementioned conversion algorithm including STEP 1 through STEP 6, indicating that output differences of the photodetector caused by various factors in the optical detecting unit can be automatically corrected.

FIG. 33 illustrates diffuse reflection conversion values which are obtained by converting the output voltage values of FIG. 32 according to the abovementioned conversion algorithm including STEP 1 through STEP 6. The LED current was adjusted during the measurements such that the regular reflection output voltage from the background of the transfer belt 18 was brought to be equal to 4.0 volts.

The results shown in FIGS. 32 and 33 clearly indicates that output differences of the photodetector caused by various factors in the optical detecting unit can be automatically corrected using the algorithm according to the invention, with excellent accuracy on the part of the algorithm, i.e., the software part, without providing strict adjustment on the part of the hardware.

The optical detecting unit used in the embodiment consists of one light emitting diode and two photodetectors, one for detecting the regular reflection and the other for the diffuse reflection, as illustrated in FIG. 4. However, a similar detection capability can be realized by using an optical detecting unit incorporating the beam splitter 58 illustrated in FIG. 5.

Also in the second embodiment, although the transfer belt 18 is taken as the target surface to be detected, the respective photosensitive drums may alternatively be used as the detection target surface. In this case, the P sensor 40 is provided so as to face the respective photosensitive drums.

Figure 34:
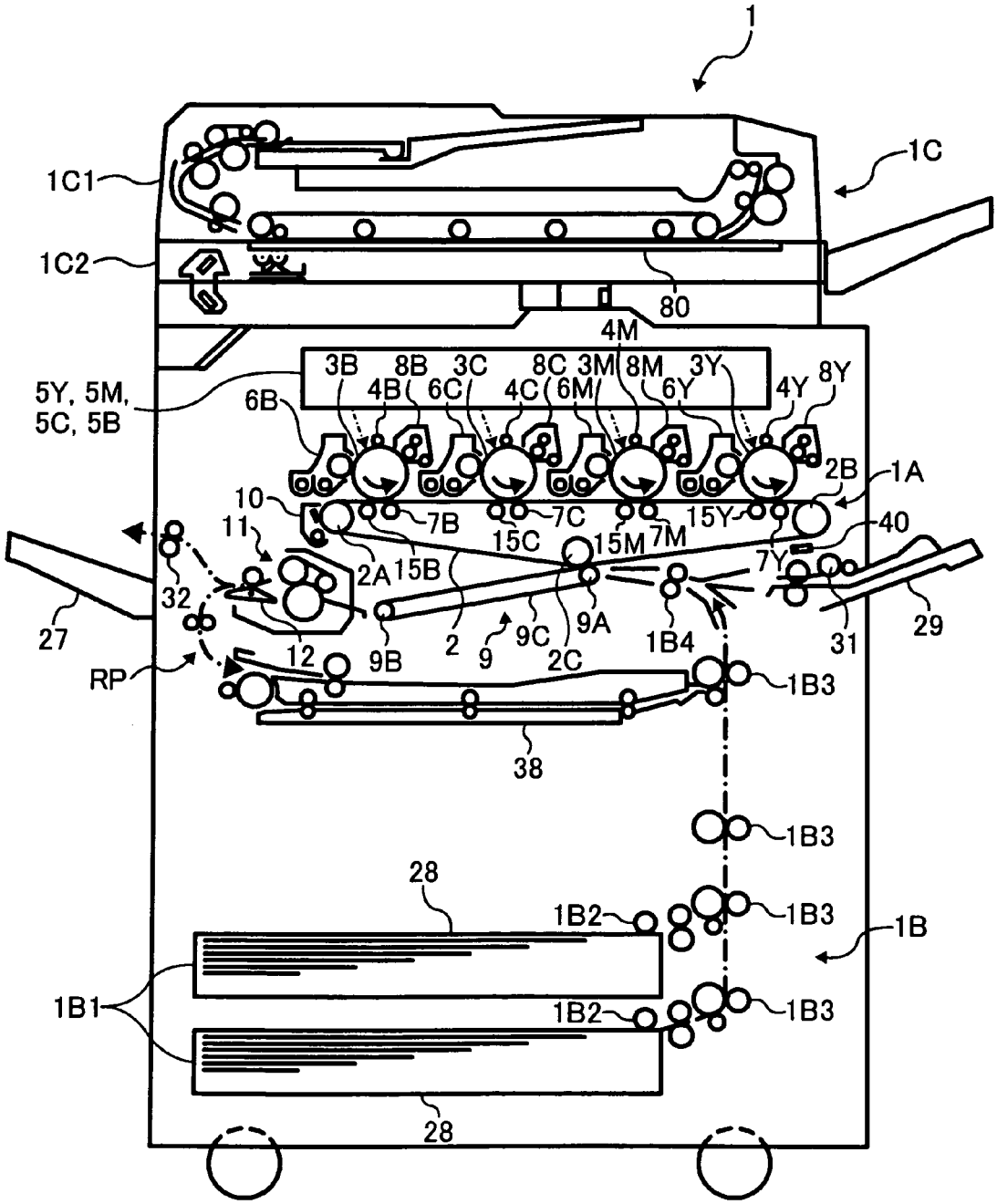
FIG. 34 is a diagrammatic frontal view illustrating the four-chambered tandem type full-color image forming apparatus provided with an intermediate transfer belt, which is capable of implementing the methods of the invention.

Although the above descriptions were made on the four-chambered tandem type direct transfer full-color laser printer, the image-forming operation can alternatively be carried out in similar manner with another four-chambered tandem type image-forming apparatus of FIG. 34 provided with an intermediate transfer belt, in which toner images are transferred and superposed thereon, and then collectively transferred onto the transfer paper sheet.

In this case, the P patterns of FIG. 18 for detecting the density are formed on the intermediate transfer belt 2 as the intermediate transfer member so as to be detected by the P sensor 40 arranged close to a support roller 2B. Namely, the intermediate transfer belt 22 is taken as the target surface for the detection. The method and operation inclusive of handling of the detection data are the same as those in the earlier embodiment.

The configuration and operation of the tandem type full-color copying machine as the image forming apparatus in the second example will be described herein below.

The full-color copying apparatus 1 includes an image forming section 1A located at the center of the apparatus, a paper sheet feeder 1B located below the image-forming section 1A, and an image reading section 1C located above the image-forming section 1A.

There provided in the image forming section 1A is an intermediate transfer belt 2 as a transfer member having a transfer plane extending in the horizontal direction, and a structure for forming an image in the colors which are complementary in the color separation scheme above the intermediate transfer belt 2.

Namely, photosensitive drums 3Y, 3M, 3C, and 3B as image bearing members capable of carrying images of color toner particles in a complementary relation (yellow, magenta, cyan, and black) are juxtaposed along the transfer plane of the intermediate transfer belt 2.

The respective photosensitive drums 3Y, 3M, 3C, and 3B are each formed of drums rotatable in the same counterclockwise direction.

There provided surrounding the respective drums are charging units 4Y, 4M, 4C, and 4B as charging means configured to perform image forming processes during rotation; optical write units 5Y, 5M, 5C, and 5B as light exposure means configured to form electrostatic latent images of a potential VL on the respective photosensitive drums 3Y, 3M, 3C, and 3B based on the image information; development units 6Y, 6M, 6C, and 6B as development means configured to develops the electrostatic latent images on the respective photosensitive drums 3Y, 3M, 3C, and 3B with toner particles having the same polarity as that of the electrostatic latent image; and primary transfer units including transfer biasing rollers 7Y, 7M, 7C, and 7B, voltage applying members 15Y, 15M, 15C, and 15B, and cleaning units 8Y, 8M, 8C, and 8B, respectively.

The alphabetical notation added to the reference number corresponds to respective toner colors in a manner similar to the photosensitive drums 3Y, 3M, 3C, and 3B. The toner particles in respective colors are stored in the development units 6Y, 6M, 6C, and 6B.

The intermediate transfer belt 2 spanned around a plurality of rollers 2A, 2B, and 22C is configured to advance in the same direction with the photosensitive drums 3Y, 3M, 3C, and 3B respectively opposing thereto.

Being separated functionally from the rollers 2A and 2B provided to support the transfer plane, the roller 2C is arranged to face a secondary transfer unit 9 with the intermediate transfer belt 2 intervened therebetween. The symbol 10 denotes another cleaning unit for the intermediate transfer belt 2.

The process of image formation is now illustrated on yellow images.

The surface of the photosensitive drum 3Y is uniformly charged by the charging unit 4Y and an electrostatic latent image is formed on the photosensitive drum 3Y based on the image information from the image reading section 1C.

The electrostatic latent image is visualized as a toner image by a two-component (carrier and toner) development unit 6Y which stores yellow toner particles. As the first transfer step, the toner image is then attracted and transferred to the intermediate transfer belt 2 by an electric field caused by the voltage applied to the transfer biasing roller 7Y.

The voltage applying member 15Y is provided upstream of the transfer biasing roller 7Y in the rotation direction of the photosensitive drum 3Y. The voltage applying member 15Y applies a voltage having the same polarity as that of the photosensitive drum 3Y and having an absolute value larger than that of VL for filled-in image areas to the intermediate transfer belt 2, so that it is prevented that the toner is transferred to the intermediate transfer belt 2 from the photosensitive drum 3Y before the toner image enters into the transfer region, and prevent the disturbance due to dust at the time of transferring the toner from the photosensitive drum 3Y to the intermediate transfer belt 2.

The image formation is performed for other photosensitive drums 3M, 3C, and 3B in a manner similar to the photosensitive drum 3Y with the exception that only the color of toner particles are different, and images in respective color are transferred and superposed on the intermediate transfer belt 2, sequentially.

After the image transfer, the toner particles remaining on the photosensitive drums 3Y, 3M, 3C, and 3B are respectively removed by the cleaning unit 8Y, 8M, 8C, and 8B, and the potential of the photosensitive drums 3Y, 3M, 3C, and 3B is initialized by a discharging lamp (not shown) and prepared for the next imaging cycle.

The secondary transfer secondary transfer unit 9 includes a transfer belt 9C wound around a charging drive roller 9A and a driven roller 9B, and moving in the same direction as the intermediate transfer belt 2. By charging the transfer belt 9C with the charging drive roller 9A, either a multi-color image superposed on the intermediate transfer belt 2 or a monochrome image carried thereon can be transferred to a sheet 28 as the recording sheet medium.

The paper sheet 28 fed from a paper feeder 1B is forwarded to a secondary transfer position. The paper feeder 1B is provided with a plurality of paper feed cassettes 1B1 in which the paper sheet 28 is loaded, a feeding roller 1B2 which separates the paper sheets 28 stored in the paper feed cassette 1B1 one by one sequentially from top to be fed forward, carrier roller pairs 1B3, and a registration roller pair 1B4 located upstream of the secondary transfer position.

The paper sheet 28 forwarded from the paper feed cassette 1B1 is temporarily stopped by the registration roller pairs 1B4. After a sheet skew being corrected, the paper sheet 28 is forwarded to the secondary transfer position at such timing that the edge of a toner image formed on the intermediate transfer belt 2 coincides with a predetermined position at the leading edge of the transfer paper in the conveyance direction.

A manual feed tray 29 is provided foldably on the right side of a main chases of the apparatus, and the paper sheet 28 stored in the manual feed tray 29 is fed toward the registration roller pair 1B4 through the path which joins a paper carrier path from the paper feed cassette 1B1 fed by the feed roller 31.

In the optical write units 5Y, 5M, 5C, and 5B, light beams for writing are controlled by the image information either from the image reader 1C or the image information output from a computer (not shown). According to the image information, writing beams are emitted toward the photosensitive drums 3Y, 3M, 3C, and 3B so as to generate an electrostatic latent image.

The image reader 1C is provided with an automatic document feeder 1C1, a scanner 1C2 having a contact glass 80 as a document platen, and other similar units.

The automatic document feeder 1C1 is configured to be capable of inverting the document forwarded onto the contact glass 80 so that scanning of both sides of the document is feasible.

The electrostatic latent images formed on the photosensitive drums 3Y, 3M, 3C, and 3B by the optical write units 5Y, 5M, 5C, and 5B are visualized by the development units 6Y, 6M, 6C, and 6B, and subjected to the primary image transfer to the intermediate transfer belt 2. After the toner images for the respective colors are transferred and superposed on the intermediate transfer belt 2, these images are secondary-transferred to the paper sheet 28 collectively by the secondary transfer unit 9. The secondary-transferred paper sheet 28 is sent to the fixing unit 11, where the image is fixed by heating under pressure. The residual toner after the secondary transfer on the intermediate transfer belt 2 is removed by the cleaning unit 10.

After passing through the fixing unit 11, the paper sheet 28 is selectively guided to either transport path toward the output tray 27 or an inverting path RP, by a path switching gate or finger 12 provided downstream of the fixing unit 11.

In the case when carried toward the output tray 27, the paper sheet 28 is ejected onto the output tray 27 by an ejection roller pair 32 to be subsequently stacked. When guided to the inverting reversing path RP, by contrast, the side of the sheet 28 is inverted by an inverting unit 38, and fed again to the registration roller pair 1B4.

In the full-color copying apparatus 1 with such a configuration, an electrostatic latent image is formed on uniformly charged photosensitive drums 3Y, 3M, 3C, and 3B by exposing and scanning the document placed on the contact glass 80, or according to the image information from the computer. After the electrostatic latent image is visualized by the development units 6Y, 6M, 6C, and 6B, the toner image is primary-transferred onto the intermediate transfer belt 2.

The toner image transferred to the intermediate transfer belt 2 is subsequently transferred onto the paper sheet 28 fed from the paper feeder 1B in the case of the monochrome image. In the case of the multiple-color imaging, the images in respective colors are superposed on each other by repeating the primary transfer, and the images are secondary-transferred collectively onto the paper sheet 28.

Subsequent the secondary transfer and fixing the unfixed images by the fixing unit 11, the paper sheet 28 is either ejected onto the output tray 27 or sent to the registration roller pair 1B4 again with the side thereof inverted for the duplex printing.

Although the intermediate transfer belt 2 is taken as the target surface to be detected in the present embodiment, the respective photosensitive drums may alternatively be used as the detection target surface. In this case, the P sensor 40 is provided so as to face the respective photosensitive drums.

In another example, the method of the invention may also be implemented in a further image formation with a full-color image forming apparatus provided with one single photosensitive drum and a revolver-type developing unit. In the image forming apparatus, toner images in respective colors are formed using the photosensitive drum, and the respective toner images are transferred and superposed on an intermediate transfer member, then transferred collectively to a transfer paper sheet as the recording medium, as will be described herein below in reference to FIG. 35.

In this example, P patterns for detecting the density illustrated earlier in FIG. 18 are formed on an intermediate transfer belt 426 as the intermediate transfer member, and these patterns are detected by P sensor 40 arranged in the vicinity of the drive roller 444. Namely, the intermediate transfer belt 426 is the target surface to be detected. The detection method and operation (including the handling of the detection data and the like) are the same those described in the earlier embodiments.

The configuration and operation of the full-color copying machine as the image forming apparatus in the third example are as follows.

In the full-color copying machine, an optical write unit 400 as the exposure unit converts color image data from a color scanner 200 to an optical signal, and perform optical writing corresponding to the original document image, to form an electrostatic latent image on a photosensitive drum 402 as an image bearing member.

The write optical unit 400 includes a laser diode 404, a polygon mirror 406 and a motor 408 for driving its rotation, an f-θ lens 410, and a reflecting mirror 412.

The photosensitive drum 402 is driven to rotate in a counterclockwise direction as indicated by the arrow in the drawing.

There provided in the periphery of the photosensitive drum 402 are a photosensitive drum cleaning unit 414, a charge dissipating lamp 416, a potential sensor 420, a development unit selected from the rotatory development unit 422, a development density pattern detector 424, and an intermediate transfer belt 426 as the intermediate transfer member.

The rotatable development unit 422 is provided with a black development unit 428, a cyan development unit 430, a magenta development unit 432, a yellow development unit 434, and a rotary driving unit (not shown) for rotating respective development units. These development units are each so-called two-component development units containing mixed developer with carrier granules and toner particles, and have the similar configuration as that of the development unit 4. The condition and the specification of the magnetic carrier are the same.

On standby the rotary development unit 422 is set to the position of black development, and when the copying operation starts, the reading out of black image data is initiated at a predetermined timing by the color scanner 200. Subsequently, based on the image data, optical writing with laser beams and the formation of an electrostatic latent image (black electrostatic latent image) are started.

In order to implement the development from the leading edge portion of the black latent image, the rotation of developing sleeve is started to develop the black electrostatic latent image with the black toner before the leading portion of the latent image arrives at the developing position of the black development unit 428. A toner image of the negative polarity is formed on the photosensitive drum 402.

Subsequently, the development operation for the area of black latent image continues. At the point when the tailing edge portion of the latent image passes the black developing position, the rotatory development unit 422 promptly rotates from the black developing position to the next color developing position. This operation is to be completed at least by the time when the leading portion of the next latent image by the image data arrives at that developing position.

On starting the image forming cycle, the photosensitive drum 402 is firstly rotated in the counterclockwise direction indicated by the arrow in the drawing, and the intermediate transfer belt 426 is rotated in the clockwise direction, by a driving motor (not shown).

Along the rotation of the intermediate transfer belt 426 following the black toner image, the formation of the cyan toner image, magenta toner image, and yellow toner image are performed, and finally superposed on the intermediate transfer belt 426 (primary transfer) in order of black (Bk), cyan (C), magenta (M), and yellow (Y), whereby toner images are formed.

The intermediate transfer belt 426 is spanned under tension around several supporting members such as a primary transfer electrode roller 450 facing the photosensitive drum 402, a driving roller 444, a secondary transfer facing roller 446 opposing a secondary transfer roller 454, and a cleaning facing roller 448A opposing a cleaning unit 452 adapted to clean the surface of the intermediate transfer belt 426. The belt 426 is controllably driven by a driving motor (not shown).

The toner images in the colors of black, cyan, magenta, and yellow sequentially formed on the photosensitive drum 402 are again sequentially registered on the intermediate transfer belt 426, whereby full-color superposed belt transfer images are formed. The belt transfer images are transferred collectively to a paper sheet with the roller 446.

Paper sheets in various sizes, which are different from those of the sheets stored in a cassette 464 in the main chases of the apparatus, are stored in recording sheet cassettes 458, 460, and 464 in a feed bank 456.

Figure 35:
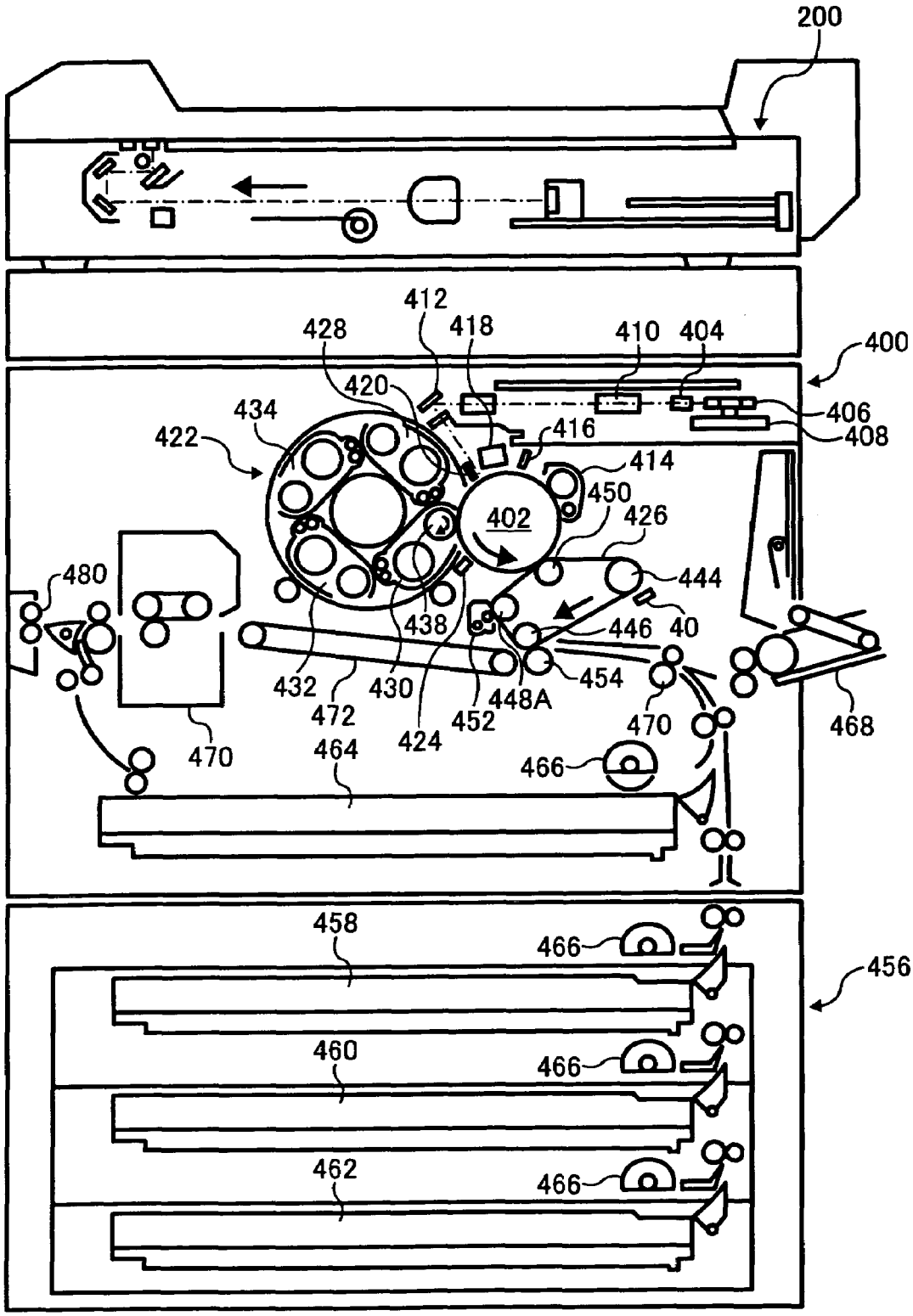
FIG. 35 is a diagrammatic frontal view illustrating the full-color image forming apparatus provided with one single photosensitive drum and a revolver-type developing unit, which is also capable of implementing the methods of the invention.

From the storage cassette for the paper sheet of specified size between these cassettes, the specified paper is fed forward in the direction toward a registration roller pair 470 by a feed roller 466. In FIG. 35, the mark 468 indicates a manual-feed tray for transparencies for overhead projector (OHP) or thick paper sheets.

When the image forming is initiated, a sheet is forwarded from the outlet of one of the abovementioned cassettes, and is on standby at the nip of the registration roller pair 470.

The resist roller pair 470 is driven such that when the leading edge of the toner image on the intermediate transfer belt 426 approaches the secondary transfer facing roller 446, the edge of the sheet coincides with that of the image. Then, the registration is achieved between the sheet and the image.

The sheet is subsequently superposed on the intermediate transfer belt 426 and passes under the secondary transfer facing roller 446, to which the voltage of the polarity the same as that of the toner is applied, and the toner image is transferred to the sheet at this time. Subsequently, the sheet is eliminated from the charge, separated from the intermediate transfer belt 426, and forwarded to a conveyor belt 472.

The sheet on which the superposed full-color images are collectively transferred from the intermediate transfer belt 426 is then forwarded to a fixing unit 470 of belt fixing type by the carrier belt 472, where the toner image is permanently fixed by heat under pressure. Subsequently, the fixing the sheet is ejected to the outside of the apparatus by an ejection roller pair 480 and stacked in a tray (not shown). Thus, a full-color copy is obtained.

Although the intermediate transfer belt 426 is taken as the target surface to be detected in the present embodiment, the photosensitive drum may alternatively be used as the detection target surface. In this case, the P sensor 40 is provided so as to face the photosensitive drum 402.

The detection and data processing in the above-mentioned embodiments is performed based on the minimum value of the ratio between the regular reflection output and the diffuse reflection output. However, the similar process can be implemented by a method based on the minimum value of the ratio between the regular reflection output increment and the diffuse reflection output increment which are obtained from the difference between respective output values at the time when the light emitting unit is turned off.

Also in the respective embodiments, the image forming apparatuses are illustrated as toner transfer detection apparatuses. However, the apparatuses may be configured alternatively to deal with powder particles other than the toner particles in which the similar detection capability can be realized by the similar processing method.

It is apparent from the above description including the examples disclosed that the method and apparatus for detecting the amount of powder adhesion of the invention can offer several advantages over similar methods and apparatuses previously known.

In the methods previously known, for example, the detectable range of the amount of color toner adhesion is gradually narrowed with the decrease in gloss level over time on the target surface to be detected, and the deterioration of the target surface due to the wear becomes a rate-limiting factor of the device life. In the method of the present invention, by contrast, the transfer detectable range is widened by performing the conversion processing compared with that of the conventional detection of regular reflection light, whereby accurate transfer detection can be performed independent of the gloss level.

In addition, since the adhesion amount detection does not depend on the deterioration of the target surface due to wear, the life of the target surface for the detection can be extended.

By applying the regular reflection output conversion algorithm to the transfer detection in which the image carrier or the transfer body in the color image forming apparatus is designated as the detection target surface, the adhesion amount can be converted without any difficulty even on a detection target surface such as a belt having a low gloss level, in which it has been considered difficult to detect the density in the conventional technique, and density control can be performed based on the adhesion amount conversion value.

Still in addition, by performing the conversion processing, in the low adhesion amount ranging from zero to one toner layer formation, the diffuse reflection output can be converted to the value for which a linear relation with respect to the adhesion amount can be obtained.

By performing the conversion processing (the automatic correction capability of the diffuse reflection-output sensitivity), the difference in the diffuse reflection output (on the part of hardware) resulting from an output difference of the light emitting diode and from the photodetector in the density detection sensor can be corrected on the adhesion amount conversion algorithm (on the part of software).

As a result, the adjustment operation by the sensor (on the part of hardware) at the time of delivery inspection, which has been carried out until now, becomes unnecessary, or the extent of adjustable allowance can be greatly expanded.

The results obtained from experimentation by the present applicant indicate that the adjustment can be performed in less than ten seconds in the present method as a result of the extended allowance range, which is considerably advantageous comparing with the time of approximately two minutes required for the output adjustment according to the previous method.

As a result, the productivity of sensor devices can be considerably improved, thereby contributing to costs reduction of the sensor and image forming apparatuses as well.

In addition, a stable adhesion amount conversion can be performed at all times by the automatic correction function for the diffuse reflection output sensitivity with respect to the decrease in the LED light intensity with the lapse of time in the density detection sensor, and an output change of the light emitting diode and the photodetector due to the temperature characteristic changes.

Even when the target surface is black in color, for which sensitivity calibration has been difficult in the conventional technique with the sensor using only the diffuse reflection output (aforementioned type B), accurate sensitivity calibration and transfer detection can be performed.

Further, in the sensor used in the method previously known for both regular reflection output and diffuse reflection output (types C and D), the accuracy in adhesion amount detection decreases with the lapse of time, caused by device characteristic change due to deterioration of the target surface. However, since the characteristic change of the target surface with time can be detected by the conversion algorithm (on the part of software) by the automatic correction function for the diffuse reflection output sensitivity, the diffuse reflection output can be converted to the adhesion amount accurately, regardless of the gloss level even when the gloss level of target surface is significantly low, or in the case of black.

As a result, an extended life of the target surface and a reduction of running costs can be achieved.

By applying the diffuse reflection output conversion algorithm to adhesion amount detection in which the image bearing member or the transfer member in the color image forming apparatus is designated as the target surface to be detected, the detection of adhesion amount can be performed without any difficulty, even on a belt having a low gloss level, in which it has been considered difficult to detect the density in the conventional technique, or even when the target surface is the belt in black. As a result, the solid adhesion amount as the maximum adhesion value can be detected. Therefore, stable image density control can be achieved at all times, regardless of the change with time or in environmental conditions.

Moreover, the life of the photosensitive material as the target surface to be detected, or the image bearing member such as a transfer belt can be extended. The target surface of the transfer belt and the like are generally formed integrally into one single unit together with the development unit or other similar units, and collective or batch replacing method is adopted in general.

However, since premature collective replacement, which may be prompted by decreased detection accuracy resulted from deterioration only of the target surface, can be avoided after the present detection method, the running costs can be considerably reduced, in view of other units or parts which still have valid service life.

More accurate adhesion amount conversion becomes feasible by providing at least one, and preferably at least three gradation patterns (the number of adhesion amount patches) in the vicinity of the adhesion amount where the minimum value of the ratio between the regular reflection output and the diffuse reflection output is obtained.

Alternatively, such a conversion may become feasible by providing at least one, and preferably at least three transfer patterns in the vicinity of the adhesion amount where the minimum value of the ratio between the regular reflection output increment and the diffuse reflection output increment, which are obtained from the difference between respective output values at the time when the light emitting unit is turned off.

Still alternatively, a similar conversion may become feasible by providing at least one, or preferably at least three patterns may be included within the range of adhesion amount, where the regular reflection output conversion values have a linear relationship with respect to the adhesion amount.

The process steps set forth in the present description on detecting the amount of powder adhesion such as toner may be implemented using conventional general purpose microprocessors, programmed according to the teachings in the present specification, as will be appreciated to those skilled in the relevant arts. Appropriate software coding can readily be prepared by skilled programmers based on the teachings of the present disclosure, as will also be apparent to those skilled in the relevant arts.

The present specification thus include also a computer-based product which may be hosted on a storage medium, and include instructions which can be used to program a microprocessor to perform a process in accordance with the present disclosure. This storage medium can include, but not limited to, any type of disc including floppy discs, optical discs, CD-ROMs, magneto-optical discs, ROMs, RAMs, EPROMs, EEPROMs, flash memory, magnetic or optical cards, or any type of media suitable for storing electronic instructions.

While the invention has been described in conjunction with the preferred embodiments, including specific units and configurations, it is evident that many alternatives and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method of converting an amount of adhesion of powder patterns on a surface, said method comprising the steps of:

forming a plurality of gradation powder patterns continuously on a surface, the plurality of gradation powder patterns each having a different amount of adhesion to the surface;

optically detecting light incident upon each of the plurality of gradation powder patterns from a light emitting device with a sensor configured to simultaneously detect regular reflection light and diffuse reflection light to obtain a regular reflection output voltage and a diffuse reflection output voltage, respectively;

computing a normalization value as a relative output ratio of the regular reflection output voltage to a background regular reflection voltage component from the surface extracted from the regular reflection light;

obtaining a diffuse reflection output conversion factor by one of (1) subtracting the normalization value multiplied by the diffuse reflection output voltage from the diffuse reflection output voltage, and (2) subtracting the normalization value multiplied by a diffuse reflection output voltage increment, which is computed as a difference between the diffuse reflection output voltage and another diffuse reflection output voltage obtained when the light emitting device is turned off, from the diffuse reflection output voltage increment; and subjecting a relation between the diffuse reflection output conversion factor and the amount of adhesion in an intermediate adhesion range to a polynomial approximation.

2. The method according to claim 1, wherein, based on the relation of the polynomial approximation between a regular reflection output conversion factor, as a normalization value of a regular reflection component in the regular reflection light, having a linear relation with the amount of adhesion, and the diffuse reflection output conversion factor, the diffuse reflection output conversion factor is uniquely converted to a value of the amount of adhesion by multiplying a correction factor such that a first value of the diffuse reflection output conversion factor obtained by converting a second value of the regular reflection output conversion factor is brought to be equal to a third value.

3. The method according to claim 2, wherein lightness of the surface is equal to or smaller than 20.

4. The method according to claim 2, wherein a point of reference for performing a sensitivity correction, as a regular reflection output conversion value with which the correction factor is multiplied so that a diffuse reflection output conversion value with respect to the regular reflection output conversion value becomes the third value, is in a range where a detection of an amount of regular reflection light is possible.

5. The method according to claim 2, wherein a point of reference for performing a sensitivity correction, as a certain regular reflection output conversion value with which the correction factor is multiplied so that a diffuse reflection output conversion value with respect to the certain regular reflection output conversion value becomes the third value, is in a range of the amount of adhesion equal to, or smaller than four-fifths of a value of the amount of adhesion which corresponds to the normalization value of approximately zero.

6. The method according to claim 1, wherein, based on the relation of the polynomial approximation between a regular reflection output conversion factor, as a normalization value of regular reflection component in the regular reflection light, having a linear relation with the amount of adhesion, and the diffuse reflection output conversion factor, the diffuse reflection output conversion factor is converted to a value of the amount of adhesion by multiplying a correction factor such that a first value of the diffuse reflection output conversion factor obtained by converting a second value of the regular reflection output conversion factor is brought to be equal to a third value, and by converting the diffuse reflection output conversion factor multiplied by the correction factor according to either one of a predetermined expression or a predetermined reference table between the amount of adhesion and the diffuse reflection output conversion factor.

7. The method according to claim 1, wherein lightness of the surface is equal to or smaller than 20.

8. An image-forming apparatus comprising:

means for forming a plurality of gradation powder patterns continuously on a surface, the plurality of gradation powder patterns each having a different amount of adhesion to the surface;

means for optically detecting light incident upon each of the plurality of gradation powder patterns from a light emitting device with a sensor configured to simultaneously detect regular reflection light and diffuse reflection light to obtain a regular reflection output voltage and a diffuse reflection output voltage, respectively;

means for computing a normalization value as a relative output ratio of the regular reflection output voltage to a background regular reflection component voltage from the surface extracted from the regular reflection light;

means for obtaining a diffuse reflection output conversion factor by one of(1) subtracting the normalization value multiplied by the diffuse reflection output voltage from the diffuse reflection output voltage, and (2) subtracting the normalization value multiplied by a diffuse reflection output voltage increment, which is computed as a difference between the diffuse reflection output voltage and another diffuse reflection output voltage obtained when the light emitting device is turned off, from the diffuse reflection output voltage increment; and means for subjecting a relation between the diffuse reflection output conversion factor and the amount of adhesion in an intermediate adhesion range to a polynomial approximation.

9. An image-forming apparatus comprising:

a device for forming a plurality of gradation powder patterns continuously on a surface, the plurality of gradation powder patterns each having a different amount of adhesion to the surface;

a device for optically detecting light incident upon each of the plurality of gradation powder patterns from a light emitting device with a sensor configured to simultaneously detect regular reflection light and diffuse reflection light to obtain a regular reflection output voltage and a diffuse reflection output voltage, respectively;

a device for computing a normalization value as a relative output ratio of the regular reflection output voltage to a background regular reflection voltage component from the surface extracted from the regular reflection light;

a device for obtaining a diffuse reflection output conversion factor by one of(1) subtracting the normalization value multiplied by the diffuse reflection output voltage from the diffuse reflection output voltage, and (2) subtracting the normalization value multiplied by a diffuse reflection output voltage increment, which is computed as a difference between the diffuse reflection output voltage and another diffuse reflection output voltage obtained when the light emitting device is turned off, from the diffuse reflection output voltage increment; and a device for subjecting a relation between the diffuse reflection output conversion factor and the amount of adhesion in an intermediate adhesion range to a polynomial approximation.

* * * * *